US012497208B2

(12) United States Patent
Learn

(10) Patent No.: US 12,497,208 B2
(45) Date of Patent: Dec. 16, 2025

(54) TAMPER-EVIDENT CONTAINER HAVING RELEASE FLAP AND CLOSURE TAB

(71) Applicant: PACTIV LLC, Lake Forest, IL (US)

(72) Inventor: Angela E. Learn, Gilbertsville, PA (US)

(73) Assignee: PACTIV LLC, Lake Forest, IL (US)

( * ) Notice: Subject to any disclaimer, the term of this patent is extended or adjusted under 35 U.S.C. 154(b) by 0 days.

(21) Appl. No.: 18/461,098

(22) Filed: Sep. 5, 2023

(65) Prior Publication Data

US 2024/0076097 A1 Mar. 7, 2024

Related U.S. Application Data

(63) Continuation of application No. 17/729,697, filed on Apr. 26, 2022, now Pat. No. 11,780,641.
(Continued)

(51) Int. Cl.
*B65D 5/54* (2006.01)
*B65D 5/20* (2006.01)
(Continued)

(52) U.S. Cl.
CPC ..... *B65D 5/5455* (2013.01); *B65D 5/2057* (2013.01); *B65D 5/244* (2013.01);
(Continued)

(58) Field of Classification Search
CPC .. B65D 5/5455; B65D 5/6655; B65D 5/6658; B65D 5/2057; B65D 5/665; B65D 5/667;
(Continued)

(56) References Cited

U.S. PATENT DOCUMENTS 1,108,464 A 8/1914 Morey
1,955,663 A * 4/1934 Wendell ..... B65D 5/26 229/114
(Continued)

FOREIGN PATENT DOCUMENTS

CN 105438585 A 3/2016
CN 106672372 A 5/2017
(Continued)

OTHER PUBLICATIONS

U.S. Appl. No. 17/729,697 (U.S. Appl. No. 11/780,641), filed Apr. 26, 2022, (filed Oct. 10, 2023).
(Continued)

*Primary Examiner* — Nathan J Newhouse
*Assistant Examiner* — Phillip D Schmidt
(74) *Attorney, Agent, or Firm* — Baker Botts L.L.P.

(57) ABSTRACT

Unitary blank for forming a container having a body portion with a plurality of fold lines and a cover portion. The body portion with a plurality of fold lines define a plurality of body wall portions, and each body wall portion has an upper edge. A first body wall portion includes a closure tab extending from the upper edge of the first body wall portion. The closure tab includes a closure tab flap portion and a closure tab base portion. The cover portion extends from the upper edge of a second body wall portion. The cover portion includes a cover portion flap score line extending along an upper edge of the cover portion and a release flap. A food container having a body portion and a cover portion is also provided.

14 Claims, 27 Drawing Sheets

Related U.S. Application Data

(60) Provisional application No. 63/243,269, filed on Sep. 13, 2021, provisional application No. 63/180,222, filed on Apr. 27, 2021.

(51) Int. Cl.
*B65D 5/24* (2006.01)
*B65D 5/42* (2006.01)
*B65D 5/66* (2006.01)

(52) U.S. Cl.
CPC ..... *B65D 5/4295* (2013.01); *B65D 5/6608* (2013.01); *B65D 5/6655* (2013.01)

(58) Field of Classification Search
CPC .. B65D 5/2047; B65D 5/6608; B65D 5/6602; B65D 5/001; B65D 5/46088; B65D 5/4295
USPC .... 229/148, 102, 141, 152–153, 154, 198.2, 229/930; 206/807
See application file for complete search history.

(56) References Cited

U.S. PATENT DOCUMENTS

| | | | | | |
|---|---|---|---|---|---|
| 2,923,455 | A * | 2/1960 | Tingley | B65D 5/46088 | 229/113 |
| 3,037,684 | A * | 6/1962 | Andrews | B65D 5/106 | 229/102 |
| 3,105,626 | A * | 10/1963 | McCormick | B65D 5/26 | 229/148 |
| 3,163,344 | A * | 12/1964 | Tunick | B65D 5/0015 | 206/509 |
| 3,343,660 | A * | 9/1967 | Bailey | B65D 5/6608 | 229/162.1 |
| 3,532,263 | A * | 10/1970 | Ross | B65D 5/42 | 206/521 |
| 4,063,678 | A * | 12/1977 | Hall | B65D 5/106 | 229/222 |
| 4,232,816 | A | 11/1980 | Johnson et al. | | |
| 5,467,916 | A | 11/1995 | Beales | | |
| 5,520,284 | A * | 5/1996 | Gray | B65D 5/001 | 229/149 |
| 6,481,259 | B1 * | 11/2002 | Durney | B21D 35/00 | 493/43 |
| 7,267,261 | B2 | 9/2007 | Lo Duca | | |
| 7,980,452 | B2 * | 7/2011 | Burton | B65D 5/667 | 229/148 |
| 10,099,853 | B2 * | 10/2018 | Miller | B65F 1/00 | |
| 11,186,406 | B2 * | 11/2021 | Chapman | B65D 5/667 | |
| 11,325,739 | B2 * | 5/2022 | Requena | B65D 5/2047 | |
| 11,365,021 | B2 * | 6/2022 | Borek | B65D 85/345 | |
| 11,780,641 | B2 * | 10/2023 | Learn | B65D 5/6608 | 229/102 |
| 2009/0072015 | A1 | 3/2009 | Drew et al. | | |
| 2019/0100346 | A1 | 4/2019 | Bressan et al. | | |
| 2019/0300232 | A1 | 10/2019 | Chapman et al. | | |
| 2019/0344927 | A1 * | 11/2019 | Ozgercel | B65D 5/22 | |
| 2020/0017254 | A1 * | 1/2020 | Zeiler | B65D 17/08 | |

FOREIGN PATENT DOCUMENTS

| | | | |
|---|---|---|---|
| DE | 3340798 | A1 | 3/1984 |
| EP | 2999637 | A1 | 3/2016 |
| GB | 2 251 600 | A | 7/1992 |
| WO | WO 2019/216857 | A1 | 11/2019 |

OTHER PUBLICATIONS

U.S. Appl. No. 17/729,697, Sep. 5, 2023, Issue Fee Payment.
U.S. Appl. No. 17/729,697, Jun. 2, 2023 Notice of Allowance.

* cited by examiner

TAMPER-EVIDENT CONTAINER HAVING RELEASE FLAP AND CLOSURE TAB

CROSS-REFERENCE TO RELATED APPLICATIONS

This application is a Continuation of U.S. patent application Ser. No. 17/729,697, filed Apr. 26, 2022, now allowed, which claims priority to U.S. Provisional Patent Application No. 63/180,222, filed Apr. 27, 2021, and U.S. Provisional Patent Application No. 63/243,269, filed Sep. 13, 2021, the contents of each of which are incorporated by reference in their entirety, and to each of which priority is claimed.

BACKGROUND

Field of the Disclosed Subject Matter

The disclosed subject matter relates to a tamper-evident food container for packaging and serving of food items, such as chicken nuggets, fries, and other foods. Particularly, the present disclosed subject matter is directed to a container for holding food items, wherein the container has a body portion and a cover portion secured to the container with a release flap, and a closure tab. After closure tab is released by the release flap, torn edges of the release flap will visually show and inform consumer that container has been previously opened. After the release flap has been opened; the closure tab can continue being used to hold container lid closed.

Description of Related Art

A variety of food items, such as fries, onion rings, chicken nuggets, popcorn shrimp, hamburgers and other foods, are often served from paperboard containers. These food containers can be pouch-shaped, such as commonly used for fries, or can be box-shaped and have a lid to contain the food item.

A concern among consumers and venders of such food items is that the food container might be opened by someone other than the end customer. For example, the container can be opened by a food-delivery person. A variety of features have been developed to indicate whether the container has been opened from its initial closed condition. However, such tamper-evident features often result in or require the removal of material, which results in unnecessary waste. Furthermore, conventional tamper-evident features often do not provide a clear or visible indication to the consumer that the container has been opened, without closer inspection.

It therefore is desirable to provide a tamper-evident food container with a release flap and a closure tab integrally formed with a food container to secure the food container cover.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a unitary blank for forming a container having a body portion with a plurality of fold lines and a cover portion. The body portion with a plurality of fold lines defines a plurality of body wall portions, and each body wall portion has an upper edge. A first body wall portion of the plurality of the body wall portions includes a closure tab extending from the first body wall portion. The closure tab includes a closure tab flap portion and a closure tab base portion, the closure tab flap portion is defined by a closure tab flap upper edge, a closure tab flap score line, a first closure tab flap extension line, and a second closure tab flap extension line. The cover portion extends from the upper edge of a second body wall portion of the plurality of body wall portions. The cover portion includes a cover portion flap score line extending along an upper edge of the cover portion and a release flap. The release flap is defined by a release flap fold line, a first release flap score line, a second release flap score line, a first release flap extension line, a second release flap extension line, and a release flap edge. The closure tab flap score line is offset from the upper edge of the first body wall portion such that the first closure tab flap extension line extends between the closure tab flap score line and the upper edge of the first body wall portion at a first angle relative the upper edge of the first body wall portion. The second closure tab flap extension line extends between the closure tab flap score line and the upper edge of the first body wall portion at a second angle relative the upper edge of the first body wall portion. The first release flap extension line extends across the cover portion flap score line at a third angle relative the upper edge of the cover portion. The second release flap extension line extends across the cover portion flap score line at a fourth angle relative the upper edge of the cover portion.

As embodied herein, the body portion and the cover portion can be aligned along a longitudinal axis. The blank can further include a first side flap extending from an upper edge of a third body wall portion and a second side flap extending from an upper edge of a fourth body wall portion, the first and second side flaps each defined by a side flap fold line.

As embodied herein, the closure tab can be longitudinally opposite the upper edge of the second body wall portion. The closure tab base portion can have a first side edge and a second side edge, and the first and second side edges can be perforated. The closure tab base portion can be disposed within of the first body wall portion and the closure tab flap portion can extend outwards from the upper edge of the first body wall portion. The closure tab can further include a c-cut extending from the closure tab flap score line. The closure tab flap upper edge can be substantially arcuate. The release flap can be substantially hexagonal.

As embodied herein, the blank can further include a cover portion flap extending from the cover portion, the cover portion flap defined by the cover portion flap score line of the cover portion. The cover portion flap can include an upper edge, and the cover portion flap upper edge can be substantially arcuate. The cover portion flap upper edge can include an indented c-cut, the c-cut extending inwards from the cover portion upper edge. The cover portion can further include at least one aperture.

The disclosed subject matter also includes a food container having a body portion and a cover portion joined together to define an interior of the container is provided. The body portion has a plurality of side walls, and each side wall has an upper edge. A first side wall of the plurality of side walls includes a closure tab extending from the first side wall. The closure tab includes a closure tab flap portion and a closure tab base portion. The closure tab flap portion is defined by a closure tab flap upper edge, a closure tab flap fold line, a first closure tab flap extension line, and a second closure tab flap extension line. The cover portion is moveable between an open position and a closed position by pivoting cover portion about a cover fold line. The cover portion includes a cover portion flap fold line extending along an upper edge of the cover portion and a release flap. The release flap is defined by a release flap fold line, a first release flap score line, a second release flap score line, a first release flap extension line, a second release flap extension line, and a release flap edge. The closure tab flap fold line is offset from the upper edge of the first side wall such that the first closure tab flap extension line extends between the closure tab flap score line and the upper edge of the first side wall, and the first closure tab flap extension line at a first angle relative the upper edge of the first side wall. The second closure tab flap extension line extends between the closure tab flap score line and the upper edge of the first side wall, and the second closure tab flap extension line is at a second angle relative the upper edge of the first side wall. The first release flap extension line extends across the cover portion flap score line at a third angle relative the upper edge of the cover portion. The second release flap extension line extends across the cover portion flap score line at a fourth angle relative the upper edge of the cover portion.

As embodied herein, the release flap can be moveable between a first closed position, an open position, and a second closed position. The release flap can be configured to be folded along the release flap fold line to the open position. The closure tab flap portion can be moveable between an engaged position and a disengaged position. The closure tab flap portion can be configured to be folded along the closure tab flap fold line to fold the closure tab flap portion to the engaged position, and the engaged position can be substantially perpendicular to the body portion. The closure tab base portion can be moveable between an engaged position and a disengaged position. The closure tab base portion can be configured to be pivoted along the closure tab base fold line to pivot the closure tab base portion between the engaged and disengaged positions. The closure tab base fold line can be offset from the upper edge of the first side wall. The closure tab base portion can include a first side edge and a second side edge, and the first and second side edges can be perforated. The closure tab base portion can be disposed within the first side wall. The closure tab flap portion can extend outwards from the upper edge of the first side wall. The closure tab can include a c-cut extending from the closure tab flap score line to provide structural support when the cover portion is in the closed position. The closure tab c-cut can be perpendicular to the closure tab flap portion when the closure tab flap portion is in the closed position.

As embodied herein, the container can include a cover portion flap moveable between an open position and a closed position. The cover portion flap can extend from the cover portion, the cover portion flap defined by the cover portion flap fold line of the cover portion. The cover portion flap can be configured to be folded along the cover portion flap fold line to fold the cover portion flap in the closed position, and the closed position can be substantially perpendicular to the cover portion. The cover portion can include at least one aperture.

As embodied herein, a first side flap can extend from an upper edge of a third side wall and a second side flap can extend from an upper edge of a fourth side wall. The first side flap and second side flap can be moveable between an open position and a closed position. The first side flap can be configured to be folded along a first side flap fold line to fold the first side flap in the closed position, the closed position substantially perpendicular to a body base. The second side flap can be configured to be folded along a second side flap fold line to fold the second side flap in the closed position, the closed position substantially perpendicular to the body base. The body portion can include at least one corner flap, and the at least one corner flap can be joined to the body portion by an adhesive to at least one side wall.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE DISCLOSED SUBJECT MATTER

Figure 1A:
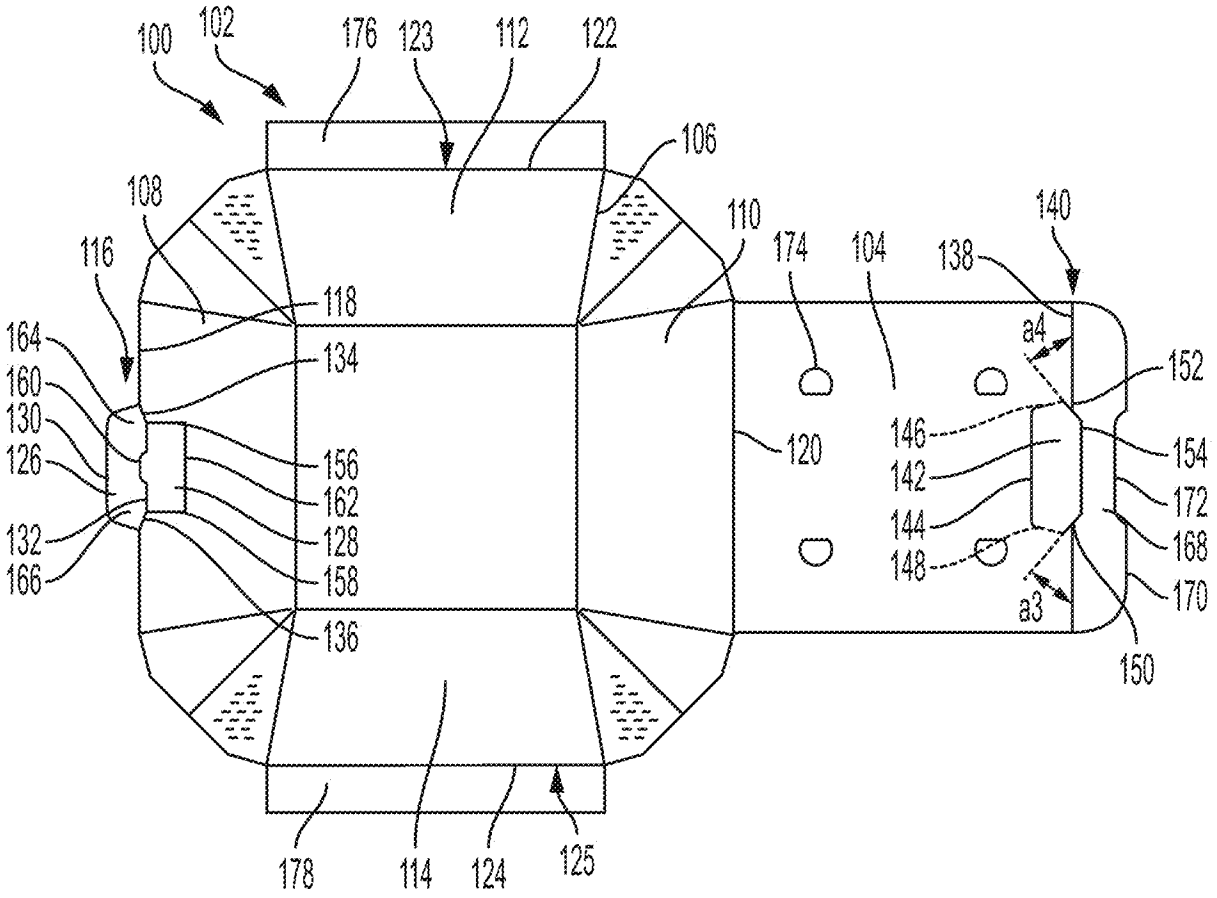
FIG. 1*a* is a plan view of a unitary blank for forming a food container in accordance with the disclosed subject matter.

Reference will now be made in detail to the disclosed subject matter, examples of which are illustrated in the accompanying drawings. The structure and corresponding method of operation of the disclosed subject matter will be described in conjunction with the detailed description of the system.

The apparatus and methods presented herein can be used for transport of food items and other perishable and non-perishable products. The disclosed subject matter is particularly suited for packaging, delivering, and serving of food items.

In accordance with the disclosed subject matter herein, a unitary blank for forming a container having a body portion with a plurality of fold lines and a cover portion is provided. The body portion with a plurality of fold lines defines a plurality of body wall portions, and each body wall portion has an upper edge. A first body wall portion of the plurality of the body wall portions includes a closure tab extending from the first body wall portion. The closure tab includes a closure tab flap portion and a closure tab base portion, the closure tab flap portion is defined by a closure tab flap upper edge, a closure tab flap score line, a first closure tab flap extension line, and a second closure tab flap extension line. The cover portion extends from the upper edge of a second body wall portion of the plurality of body wall portions. The cover portion includes a cover portion flap score line extending along an upper edge of the cover portion and a release flap. The release flap is defined by a release flap fold line, a first release flap score line, a second release flap score line, a first release flap extension line, a second release flap extension line, and a release flap edge. The closure tab flap score line is offset from the upper edge of the first body wall portion such that the first closure tab flap extension line extends between the closure tab flap score line and the upper edge of the first body wall portion at a first angle relative the upper edge of the first body wall portion. The second closure tab flap extension line extends between the closure tab flap score line and the upper edge of the first body wall portion at a second angle relative the upper edge of the first body wall portion. The first release flap extension line extends across the cover portion flap score line at a third angle relative the upper edge of the cover portion. The second release flap extension line extends across the cover portion flap score line at a fourth angle relative the upper edge of the cover portion. A food container having a body portion and a cover portion joined together to define an interior of the container and a cover to the container is also provided.

The accompanying figures, where like reference numerals refer to identical or functionally similar elements throughout the separate views, serve to further illustrate the disclosed subject matter and to explain various principles and advantages all in accordance with the disclosed subject matter. For purpose of explanation and illustration, and not limitation, blanks and containers in accordance with the disclosed subject matter are shown in FIGS. 1-10. The container is suitable for use with a wide variety of hot and cold food items, such as fruit slices, chips, bread sticks, candies, and other suitable food items. However, the container disclosed herein is particularly suitable and beneficial for use with hot, prepared food items, wherein the container can be used for storing, transporting, and/or re-using such food items as well as serving the food items. For purpose of illustration, and not limitation, reference will be made herein to a container intended to contain food items and hold a receptacle for a condiment. Additionally, as used herein, the terms "front," "rear," "side," "top," and "bottom" are used for the purpose of illustration only, and not limitation. That is, it is recognized that the terms "front," "rear," "side," "top," and "bottom" are interchangeable and are merely used herein as a point of reference. Although certain features are referred to as "cover," "base," "side," and "wall," the terms are not intended to be limiting, and a container can be placed on any of its cover, base, or side, with any of the cover, base, or side portions extending upwardly and any of the cover, base, or side portions resting along a "top."

Figure 1B:
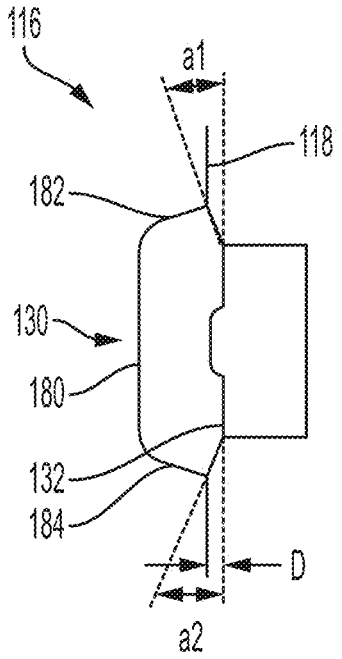
FIG. 1*b* is a plan view of the closure tab of the unitary blank of FIG. 1*a*.

For purpose of illustration, and not limitation, reference is made to the unitary blank 100 of FIGS. 1*a* and 1*b*, as well as the container 200 shown in FIGS. 2*a*-5, which can be formed by unitary blank 100. As shown in FIG. 1*a*, the unitary blank 100 generally includes a body portion 102 and a cover portion 104. The body portion 102 has a plurality of fold lines 106 and defines a plurality of body wall portions. The plurality of body wall portions includes a first body wall portion 108, a second body wall portion 110, a third body wall portion 112, and a fourth body wall portion 114. Each body wall portion has an upper edge 118, 120, 122, 124, respectively. Although four body wall portions 108, 110, 112, 114 are illustrated, any suitable number of body wall portions can be used.

As embodied herein, for illustration and not limitation, and with reference to the blank 100 of FIG. 1*a*, the first body wall portion 108 includes a closure tab 116 extending from the first body wall portion 108. The closure tab 116 includes a closure tab flap portion 126 and a closure tab base portion 128. The closure tab flap portion 128 is defined by a closure tab flap upper edge 130, a closure tab flap score line 132, a first closure tab flap extension line 134, and a second closure tab flap extension line 136. As shown in FIG. 1*b*, the closure tab flap upper edge 130 includes a middle portion 180, and two side portions, 182, 184. The closure tab flap score line 132 can be defined by a series of perforations. The closure tab flap score line 132 can be offset from the upper edge 118 of the first body wall portion 108. For example, the closure tab flap score line 132 can be offset from the upper edge 118 by a distance D, which can be about ⅛ inches. Accordingly, as shown in FIG. 1*a*, a portion of the closure tab 116 can extend into the first body wall portion 108. As shown in FIG. 1*b*, the first closure tab flap extension line 134 can extend between the closure tab flap score line 132 and the upper edge 118 of the first body wall portion 108 at a first angle "a1" relative the upper edge 118 of the first body wall portion 108. The second closure tab flap extension line 136 can extend between the closure tab flap score line 132 and the upper edge 118 of the first body wall portion 108 at a second angle "a2" relative the upper edge 118 of the first body wall portion 108. Although a particular shape and configuration of the closure tab 116 is described, any suitable shape and configuration can be used. Likewise, although one closure tab 116 is illustrated, any suitable number of closure tabs can be used.

With reference to the blank 100 of FIG. 1*a*, the body portion 102 and the cover portion 104 can be aligned along a longitudinal axis. For purpose of illustration and not limitation, the closure tab 116 can be longitudinally opposite the upper edge 120 of the second body wall portion 110. The closure tab flap portion 126 can extend outwards from the upper edge 118 of the first body wall portion 108. The closure tab flap portion 126 can further include first and second closure tab flap wings 164, 166, which are defined by first and second closure tab extension lines 134, 136 and the closure tab flap upper edge 130. The closure tab base portion 128 can have a first side edge 156 and a second side edge 158. The first and second side edges 156, 158 can be scored, such that the first and second side edges 156, 158 can be separated from the first body wall portion 108 by tearing or pressing along the edges. The closure tab base portion 128 can be disposed within the first body wall portion 108. The closure tab base portion 128 can further include a closure tab base score line 162. The closure tab base score line 162 can be defined by a series of perforations. The closure tab base score line 162 can be offset from the upper edge 118 of the first body wall portion 108. The closure tab flap upper edge 130 can be of any suitable shape and dimension, including but not limited to substantially arcuate. With reference to the blank 100 of FIG. 1*a*, the closure tab 116 can further include a c-cut 160 extending from the closure tab flap score line 132 towards the closure tab flap upper edge 132. The c-cut can be of any suitable shape and dimension, including but not limited to "c"-shaped or arcuate, radius corners, or angled straight edges. The height of the c-cut 160 can be equal to the amount of the offset of the closure tab flap scope line 162 from the upper edge 118 of the first body wall portion 108, thereby providing support for vertical stacking of multiple food containers.

As embodied herein, for illustration and not limitation, and with reference to the blank 100 of FIG. 1*a*, the cover portion 104 can include a cover portion flap score line 138 extending along an upper edge 140 of the cover portion 104 and a release flap 142. The release flap 142 can be defined by a release flap fold line 144, a first release flap score line 146, a second release flap score line 148, a first release flap extension line 150, a second release flap extension line 152, and a release flap edge 154. The first release flap extension line 150 can extend across the cover portion flap score line 138 at a third angle "a3" relative the upper edge 140 of the cover portion 104. The second release flap extension line 152 can extend across the cover portion flap score line 138 at a fourth angle "a4" relative the upper edge 140 of the cover portion 104. The release flap 142 can be of any suitable shape and dimension, including but not limited to substantially hexagonal. For example, the release flap 142 can be the mirrored larger image of the closure tab 116 to permit easy removal of the closure tab 116. The first and second release flap score lines 146, 148 can be perforated, such that the first and second release flap score lines 146, 148 can be separated from the first body wall portion 108 by tearing or pressing along the lines.

With reference to the blank 100 of FIG. 1*a*, the cover portion 104 can extend from the upper edge 120 of the second body wall portion 110. The cover portion 104 can further include a cover portion flap 168 extending from the cover portion 104, the cover portion flap 168 defined by the cover portion flap score line 138 of the cover portion 104. The cover portion flap 168 can include an upper edge 170. The cover portion flap upper edge 170 can be of any suitable shape and dimension, including but not limited to substantially arcuate. The cover portion flap upper edge 170 can include an indented c-cut 172, the c-cut 172 extending inwards from the cover portion upper edge 170. The c-cut 172 can allow single knife nesting of closure tab 116 with flap 170 to reduce material costs of multi-up production layout. The cover portion 104 can further include at least one aperture 174. The at least one aperture 174 can be partially perforated. The at least one aperture 174 can have any suitable shape and dimension, including but not limited to circles, rectangles, or octagons. The at least one aperture 174 can remain connected to package with a perforated or scored section, or the at least one aperture 174 can be fully die cut and removed during manufacture.

With reference to the blank 100 of FIG. 1*a*, the blank 100 can further comprise a first side flap 176 extending from an upper edge 122 of a third body wall portion 112, the first side flap 176 defined by a side flap score line 123. The blank 100 can further comprise a second side flap 178 extending from an upper edge 124 of a fourth body wall portion 114, the second side flaps defined by a side flap score lines 125. Although first and second side flaps 176, 178 are illustrated, any suitable number of side flaps can be used.

Figure 2A:
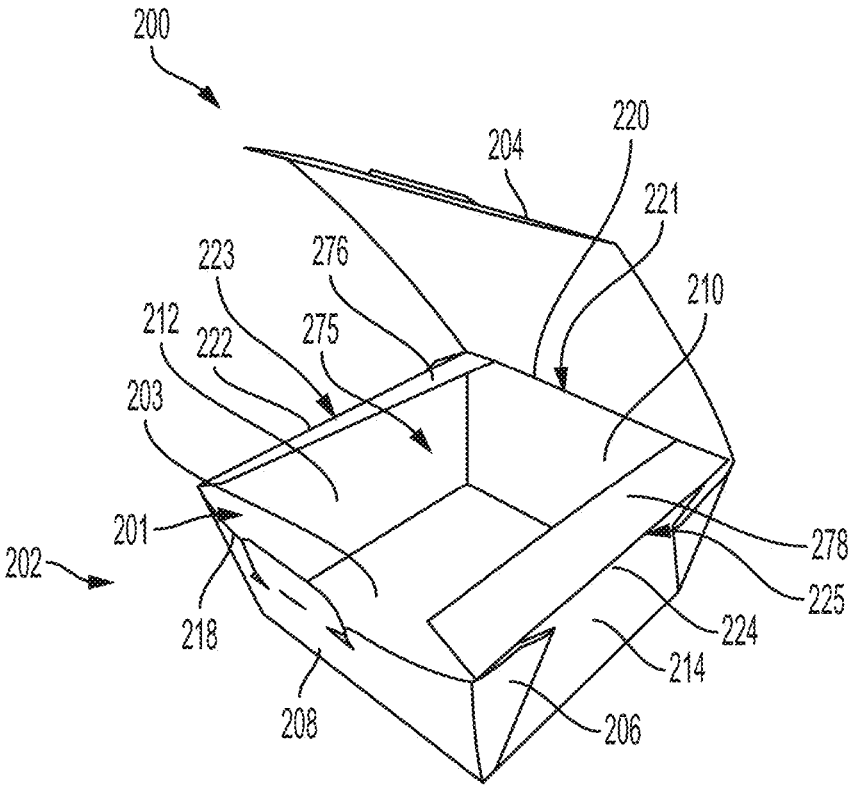
FIG. 2*a* is a perspective view of a food container in accordance with the disclosed subject matter, shown with the cover portion in an open configuration.

To form container 200 from blank 100, the plurality of folds lines 106 on body portion 102 of blank 100 can be folded to define at least one corner flap 206 of container 200, as shown in FIG. 2*a*. The plurality of body wall portions, including body wall portions 108, 110, 112, 114 of blank 100 can be folded to define four side walls 208, 210, 212, 214 of the container 200. For example, container 200 can include four corner flaps 206 and four side walls 208, 210, 212, 214. Each corner flap 206 can be joined to one of the four side walls 208, 210, 212, 214 using conventional techniques, such as by glue or thermal adhesive or the like. A body portion 202 can define an interior 275. The interior 275 can be closed by a cover portion 204, as shown in FIGS. 2*a*-2*f*. A mouth 201 of the container 200 can be defined by the side walls 208, 210, 212, 214, allowing access into the interior 275 of container 200, and the mouth 201 can be opposite a body base 203. Each side wall has an upper edge 218, 220, 222, 224, respectively. Although particular features are described, the container 200 can have one or more of the features as included in blank 100.

The first side flap 176 of blank 100 can be moveable between an open position and a closed position, and can be folded to a closed position to form first side flap 276 of container 200 by pivoting along a first side flap fold line 223, defined by upper edge 222 of the third side wall 212, as shown in FIG. 2*a*. The first side flap 276 can be configured to be folded by the first side flap fold line 222 to fold the first side flap 276 in the closed position, the closed position of the first side flap 276 substantially perpendicular to the body base 203. The second side flap 178 can be moveable between an open position and a closed position, and can be folded to a closed position to form second side flap 278 of container 200 by pivoting about a second side flap fold line 225, defined by upper edge 224 of the fourth side wall 214. The second side flap 278 can be configured to be folded along the second side flap fold line 225 to fold the second side flap 278 in the closed position, the closed position of the second side flap 278 substantially perpendicular to the body base 203.

To cover the container 200, and close the interior 275, cover portion 204 can be moveable between an open position (as shown, for example, in FIGS. 2*a*-2*b*) and a closed position (as shown, for example, in FIGS. 3*a*-4*e*) by pivoting cover portion 204 about a cover fold line 221, which is defined by upper edge 220 of side wall 210. As shown in FIGS. 2*c*-2*f*, if container 200 is provided with first, second, third, and fourth side walls 208, 210, 212, 214, cover portion 204 can be disposed to rest on the side walls 210, 212, 214 and first and second side flaps 276, 278, to cover a portion of the mouth 201 when the cover portion 204 is in the closed position.

Figure 2B:
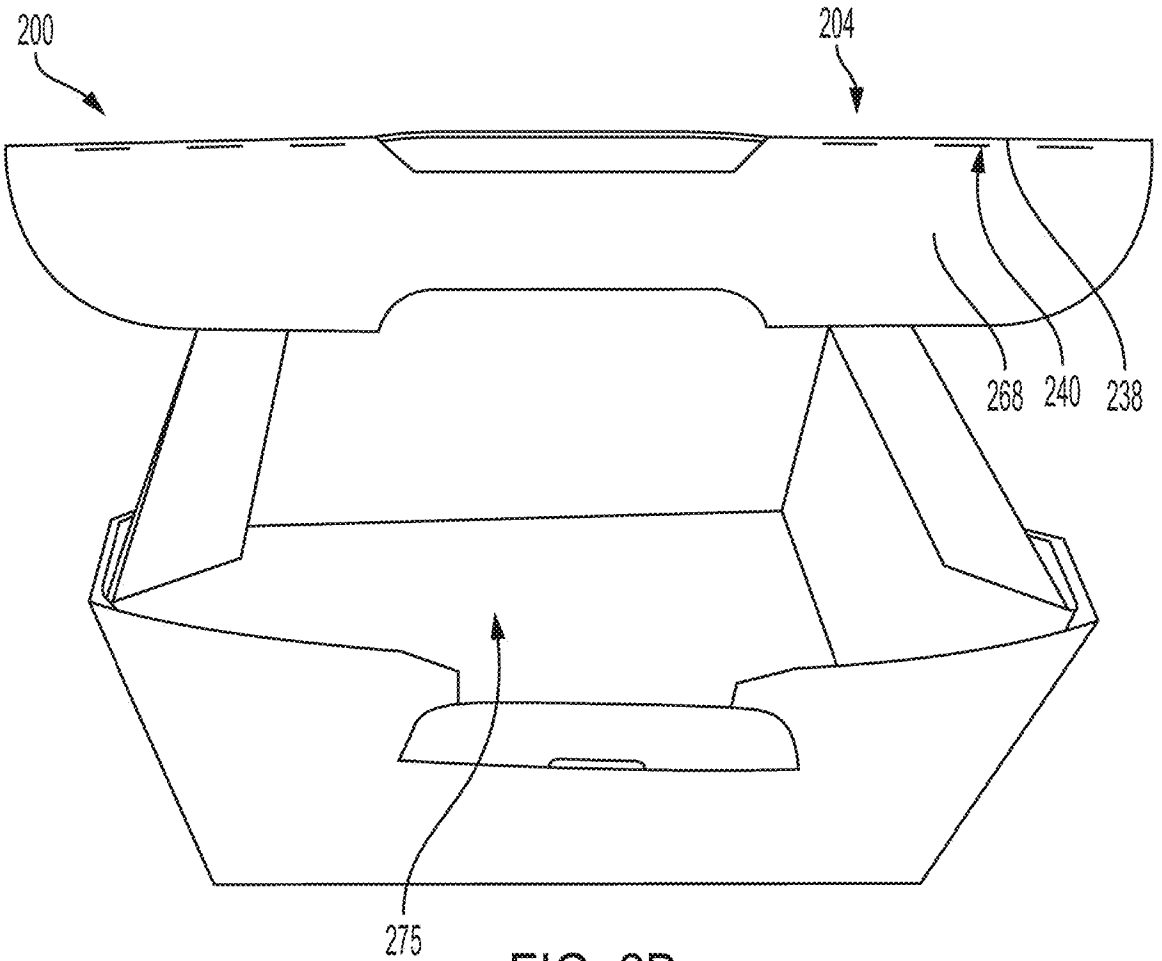
FIG. 2*b* is a front, perspective view of the container of FIG. 2*a*.
Figure 2C:
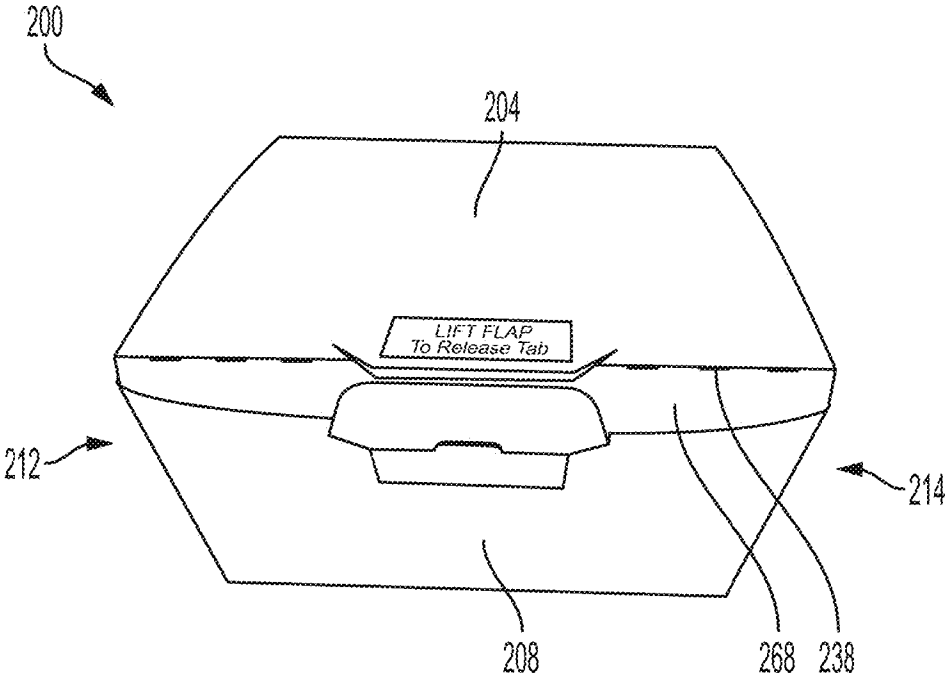
FIG. 2*c* is a front, perspective view of the container of FIG. 2*a*, shown with the cover portion in a partially closed configuration.
Figure 2D:
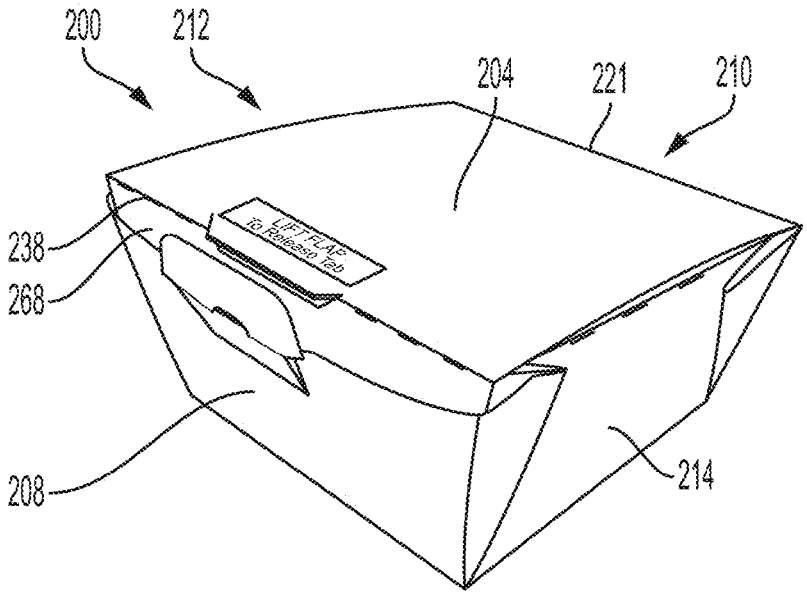
FIG. 2*d* is a perspective view of the container of FIG. 2*a*, shown with the cover portion in a partially closed configuration.
Figure 2E:
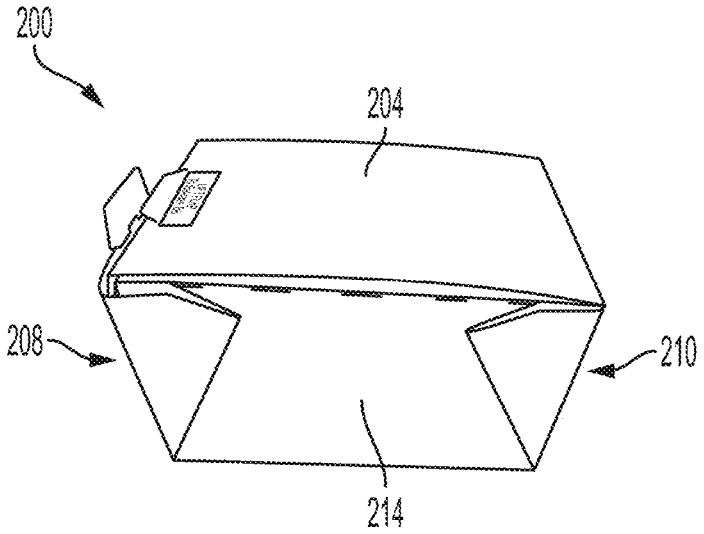
FIG. 2*e* is a side, perspective view of the container of FIG. 2*a*, shown with the cover portion in a closed configuration.

As shown in FIG. 2*b*, a cover portion flap 268 can extend from an upper edge 240 of the cover portion 204. A cover portion flap fold line 238 can extend along the upper edge 240 of the cover portion 204. The cover portion flap 268 can be moveable between an open position and a closed position by pivoting about the cover portion flap fold line 238. As shown in FIGS. 2*c*-2*d*, the cover portion flap can be configured to be folded along the cover portion flap fold line 238 to fold the cover portion flap 268 in the closed position to be inserted into container 200 when the cover portion 204 is in the closed position. As shown in FIG. 2*c*, the closed position of the cover portion flap 268 can be substantially perpendicular to the cover portion 204 and substantially parallel to the first side wall 208. Additionally, when the cover portion 204 is in the closed position, the cover portion flap fold line 238 can sit even or just proud of the upper edge 218 (see e.g., FIG. 3*a*).

Figure 2F:
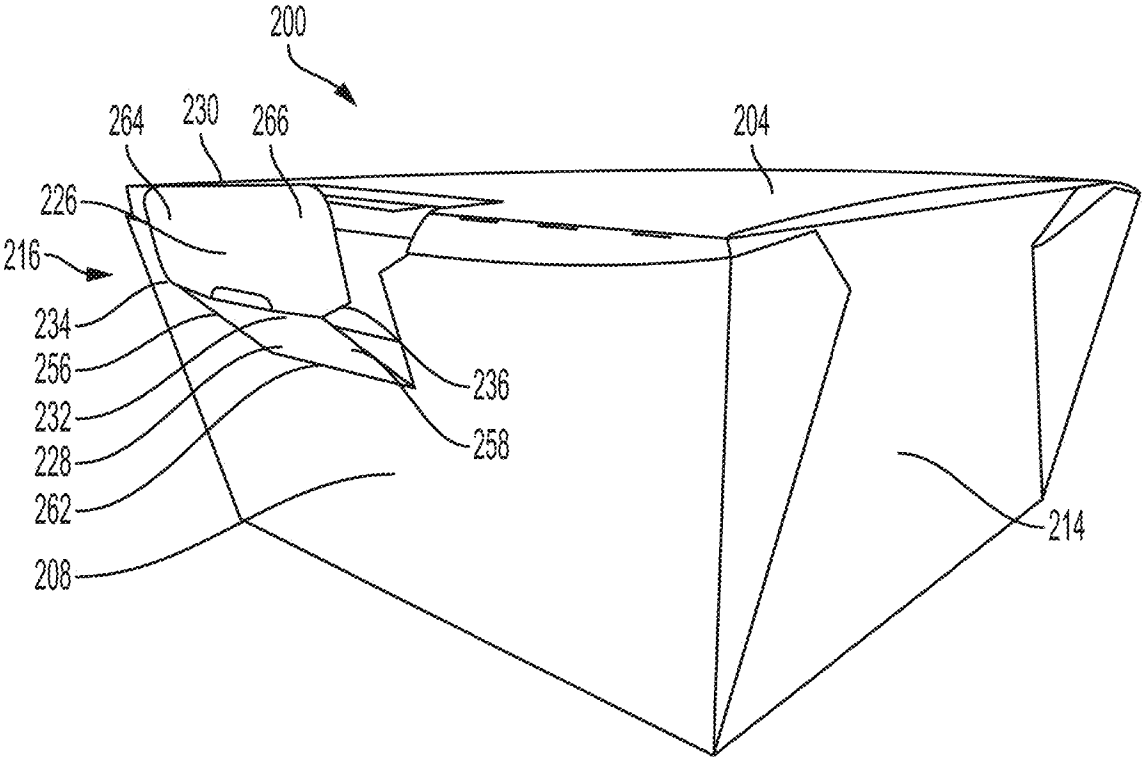
FIG. 2*f* is a perspective view of the container of FIG. 2*a*, shown with the cover portion in a closed configuration.
Figure 3A:
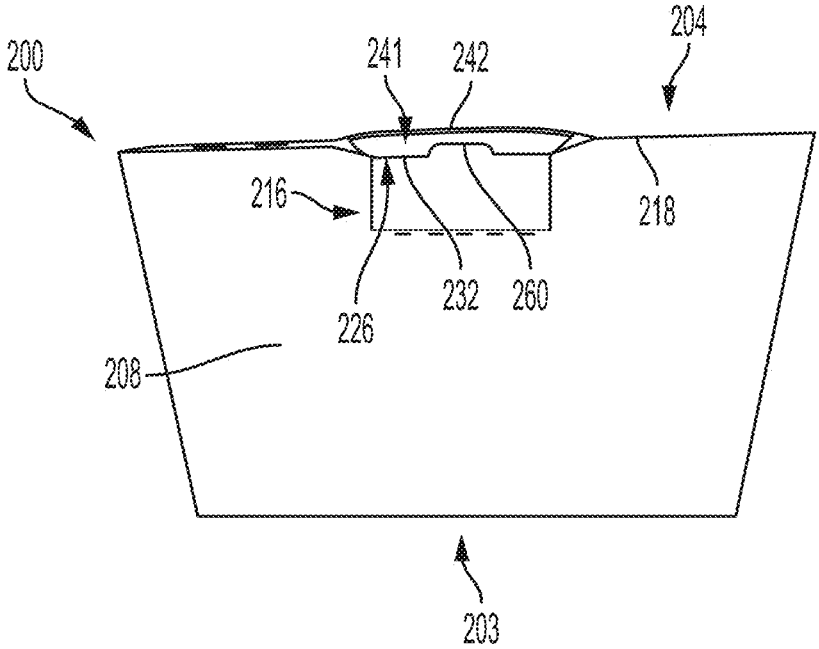
FIG. 3*a* is a front view of the container of FIG. 2*a*, shown with the closure tab flap in the engaged position to engage with the container.
Figure 3B:
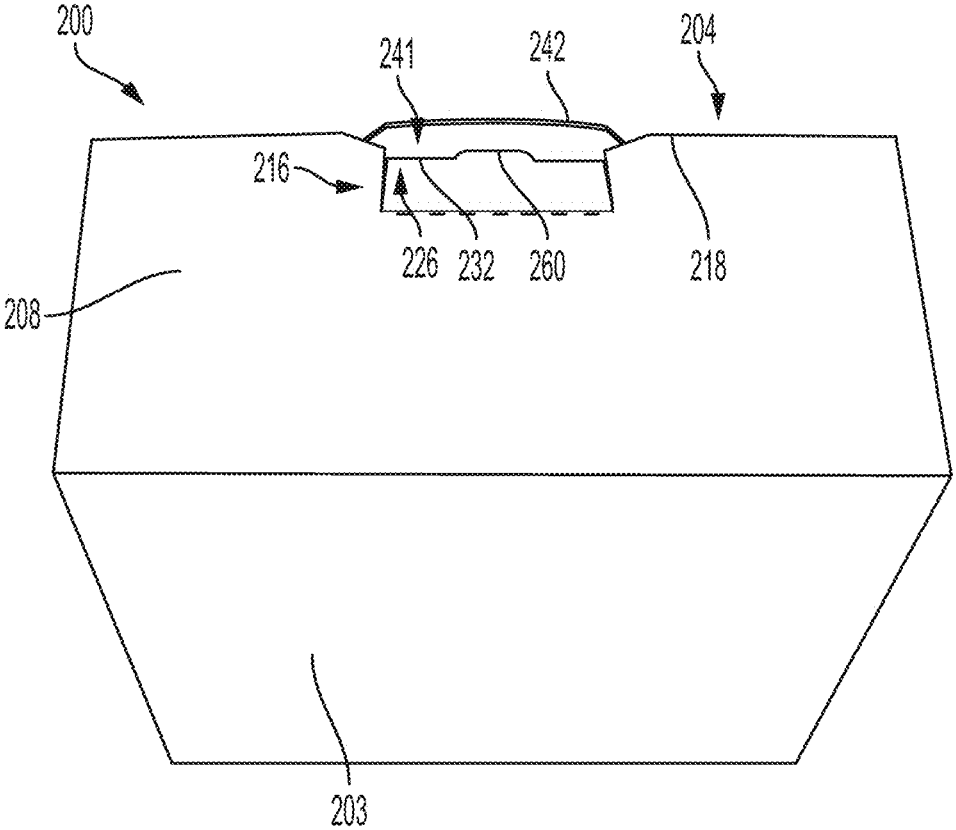
FIG. 3*b* is a bottom, perspective view of the container of FIG. 2*a*, shown with the closure tab flap in the engaged position to engage with the container.

Container 200 can include a closure tab 216. The closure tab 216 of container 200 can have one or more of the features of the closure tab 116 as included in blank 100. For example, as shown in FIG. 2*f*, the closure tab 216 can include a closure tab flap portion 226 and a closure tab base portion 228, and the closure tab flap portion 228 can be defined by a closure tab flap upper edge 230, a closure tab flap fold line 232, a first closure tab flap extension line 234, and a second closure tab flap extension line 236. The first closure tab flap extension line 234 can extend between the closure tab flap score line 232 and the upper edge 218 of the first side wall 208 at a first angle "a1" relative the upper edge 218 of the first side wall 208. The second closure tab flap extension line 236 can extend between the closure tab flap score line 232 and the upper edge 218 of the first side wall 108 at a second angle "a2" relative the upper edge 218 of the first side wall 208. The closure tab base portion 228 can have a first and second side edge 256, 258 (for example, see FIG. 2*f*), and the first and second side edges 256, 258 can be scored, such that the first and second side edges 256, 258 can be separated from the first body wall portion 208 by tearing or pressing along the edges. The closure tab flap portion 226 can be moveable between an engaged position (as shown in FIGS. 3*a*-3*b*) and disengaged position (as shown in FIGS. 2*a*-2*f* and 4*c*). The closure tab flap portion 226 can be configured to be folded along a closure tab flap fold line 232 on the closure tab 216 to fold the closure tab flap portion 226 to the engaged position. The closure tab base portion 228 can be moveable between a disengaged position (as shown in FIGS. 2*a*-2*f* and 4*c*) and an engaged position (as shown in FIGS. 3*a*-3*b*). The closure tab base portion 228 can be configured to be pivoted along a closure tab base fold line 262 on the closure tab 216 to pivot the closure tab base portion 228 between the engaged and disengaged positions. The engaged position of the closure tab flap portion 226 can be substantially perpendicular to the body base 203. As shown in FIGS. 3*a*-3*b*, the closure tab 216 can further include a c-cut 260 extending from the closure tab flap fold line 232. The c-cut 260 can extend perpendicularly relative to the closure tab flap portion 226 when the closure tab flap portion 226 is in an engaged position. The c-cut 260 can provide structural support to the container 200 when the cover portion 204 is in the closed position. Although one closure tab 216 is illustrated, any suitable number of closure tabs can be used.

Figure 4A:
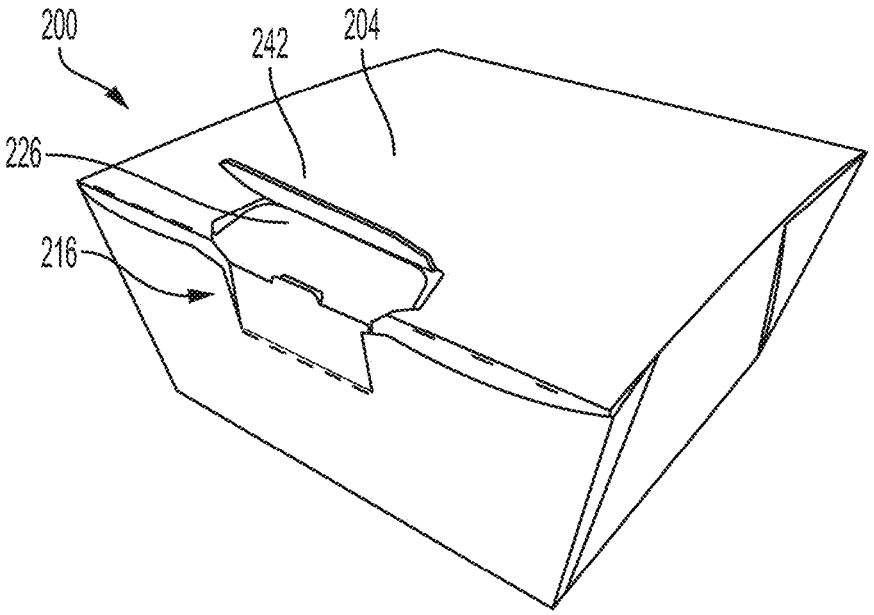
FIG. 4*a* is a perspective view of the container of FIG. 2*a*, shown with the release flap in the open configuration and with the closure tab flap in a partially engaged position.
Figure 4B:
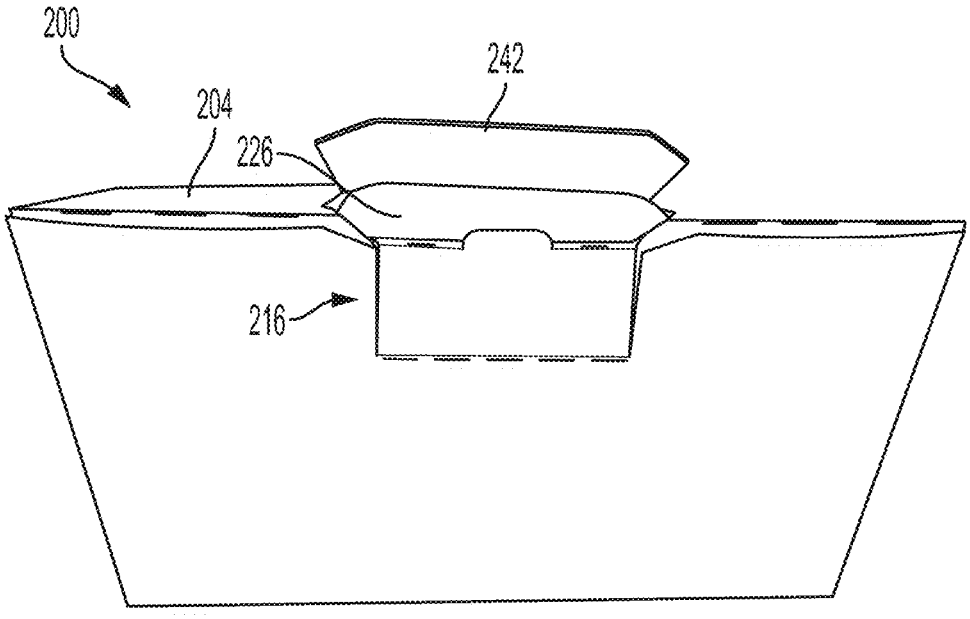
FIG. 4*b* is a front view of the container of FIG. 2*a*, shown with the release flap in the open configuration and with the closure tab flap in a partially engaged position.
Figure 4C:
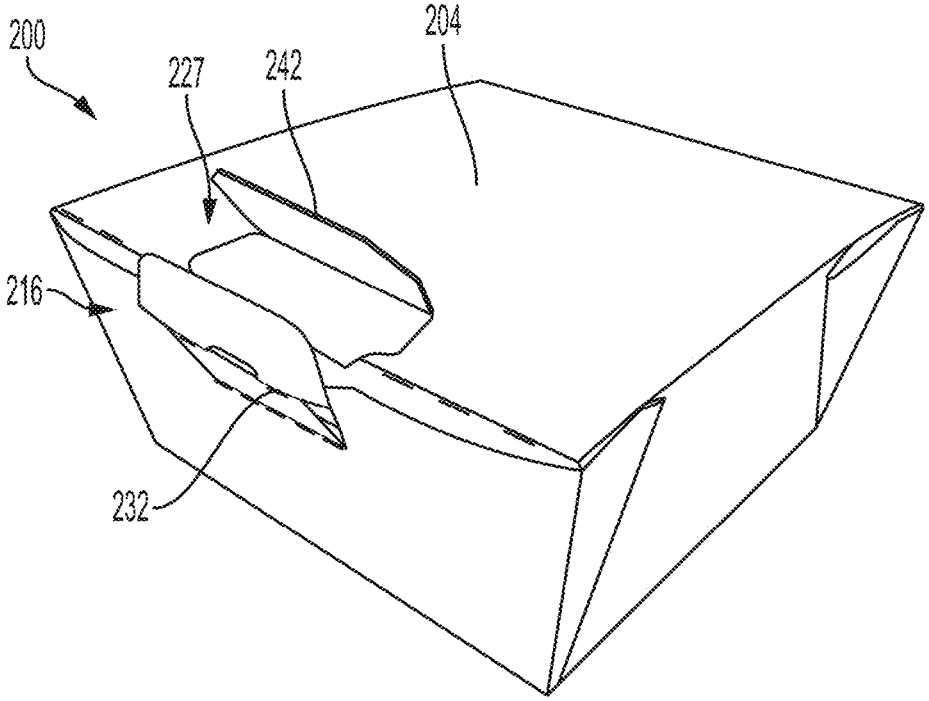
FIG. 4*c* is a perspective view of the container of FIG. 2*a*, shown with the release flap in the open configuration and with the closure tab flap in a disengaged position.
Figure 4D:
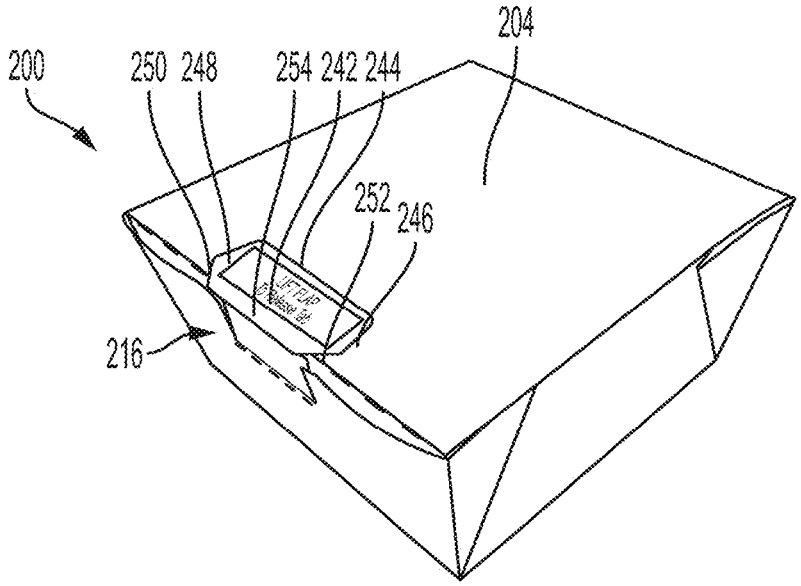
FIG. 4*d* is a perspective view of the container of FIG. 2*a*, shown with the release flap in the closed configuration and with the closure tab flap in the engaged position.

Container 200 can include release flap 242. The release flap 242 of container 200 can have one or more of the features of the release flap 142 as included in blank 100. For example, as shown in FIG. 4*d*, the release flap 242 can be defined by a release flap fold line 244, a first release flap score line 246, a second release flap score line 248, a first release flap extension line 250, a second release flap extension line 252, and a release flap edge 254. The first release flap extension line 250 can extend across the cover portion flap fold line 238 at a third angle "a3" relative the upper edge 240 of the cover portion 204. The second release flap extension line 252 can extend across the cover portion flap fold line 238 at a fourth angle "a4" relative the upper edge 240 of the cover portion 204. Although one release flap 242 is illustrated, any suitable number of release flaps can be used.

Figure 4E:
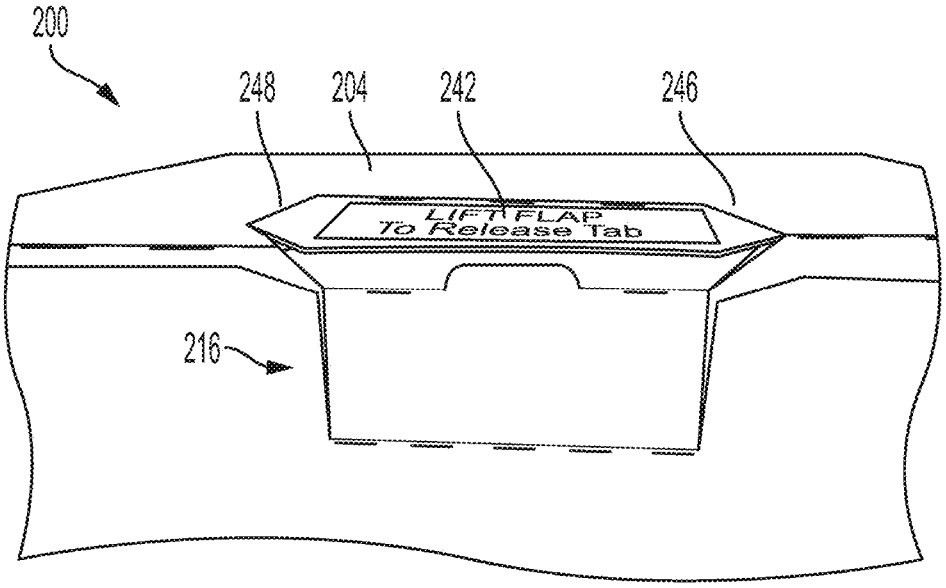
FIG. 4*e* is a front view of the container of FIG. 2*a*, shown with the release flap in the closed configuration and with the closure tab flap in the engaged position.

The release flap 242 can be moveable between three positions: (1) a first closed position (as shown in FIGS. 2*a*-2*f* and 3*a*-3*b*) in which the release flap 242 can be coupled to the lid portion 204 along first and second release flap score lines 246, 247; (2) an open position (as shown in FIGS. 4*a*-4*c*) in which the coupling between the release flap 242 and the lid portion 204 can be torn along first and second release flap score lines 246, 247, the release flap 242 can be pivoted about release flap fold line 244, and the release flap 242 can be configured to be folded about release flap fold line 244 to the open position; and (3) a second closed position (as shown in FIGS. 4*d*-4*e*) in which the release flap 242 can be pivoted about release flap fold line 244 to its initial position, but the first and second release flap score lines 246, 247 remain torn.

After food items or other perishable and nonperishable products are placed in container 200, the container can be closed and locked with a closure tab 216. As shown in FIGS. 3*a*-3*b*, when cover portion 204 is moved to the closed position and the closure tab flap portion 226 is moved to the engaged position, the closure tab flap portion 226 can be pushed into a slit 241 below a release flap 242 to engage the cover portion 204. Since the closure tab flap fold line 232 can be offset from the upper edge 218 of the first side wall 208, the closure tab flap portion 226 is not easily slid out of the slit 241 once it has engaged with the cover portion 204. In particular, when the closure tab flap portion 226 is engaged with slit 241, the closure tab flap fold line 232 will be below the upper edge 218 and the cover portion flap fold line 238. This can cause the first and second closure tab flap wings 264, 266 (as shown in FIG. 2*f*) to engage with the cover portion 204 at the first and second release flap extension lines 250, 252, respectively, which can prevent the closure tab flap portion 226 from disengaging with the cover portion 204 once closure tab flap portion 226 has been pushed into slit 241. The release flap 242 remains in the first closed position until the container 200 is opened.

To remove the food items or other perishable and non-perishable products from container 200 after it has been closed and locked, release flap 242 can be lifted, allowing the extraction of the closure tab 216, and indicating that the container 200 has been opened from its closed and locked position. Particularly, the release flap 242 is moveable from the first closed position to the open position by tearing along first and second release flap score lines 246, 248, and pivoting the release flap 242 about the release flap fold line 244 to fold the release flap 242 in the open position, as shown in FIGS. 4*a*-4*c*. As shown in FIGS. 4*a*-4*b*, when the release flap 242 is in the open position, the closure tab flap portion 226 of closure tab 216 can be disengaged from the container by pulling up on the closure tab flap portion 226 through the opening 227 (for example, as shown in FIG. 4*c*). As shown in FIG. 4*c*, when the closure flap 216 is disengaged from the container 200, the cover portion 204 can be opened to allow removal of the food items. The container can be reclosed to allow for restorage of the food items. To reclose the container, the closure tab flap portion 226 of closure tab 216 can be engaged with the container by reinserting the closure tab flap portion 226 into the opening 227, and release flap 242 can be folded to the second closed position (as shown in FIGS. 4*d*-4*e*). However, the tearing along release flap score lines 246, 248 can still be visible.

The tearing along release flap score lines 246, 248 indicates that container 200 has been opened from the first closed position. Indeed, because the container 200 cannot be opened after it is initially closed without causing destruction to the container 200 (e.g., tearing along release flap score lines 246, 248), once the container 200 has been closed (e.g., after initially placing food for delivery) it will be obvious to a user if the container has been opened because the destruction will be visible.

It is to be recognized that the dimensions and relative proportions of the body portion 102, cover portion 104, body wall portions 108, 110, 112, 114, and other features of the blank 100 or container 200 can vary according to the exact size and intended use of the blank 100 or container 200. For purpose of illustration and not limitation, with reference to the blank 100 of FIG. 1*a*, the unitary blank can have a width of about 16 to 18 inches. The body portion 102 can have a height of about 11 to 12 inches. The first and second body wall portions 108, 110 can have a width of about 2 to 3.5 inches. The first and second body wall portions 108, 110 can have a height at an inner edge of about 4 to 6 inches and a height at an outer edge of about 5 to 7 inches. The third and fourth body wall portions 112, 114 can have a height of about 2 to 3.5 inches. The third and fourth body wall portions 112, 114 can have a width at an inner edge of about 4 to 6 inches and a width at an outer edge of about 5 to 7 inches. The cover portion 104 can have a width of 5 to 7 inches. While an essentially rectangular container 200 formed by blank 100 is illustrated in FIGS. 2*a*-4*e*, one of ordinary skill will recognize that any suitable shape and depth of container 200 and corresponding blank 100 can be employed and the disclosed subject matter is not so limited. Other suitable shapes include squares, triangles, cylinders, ovals, various polygons, etc., having any suitable dimensions.

Figure 5:
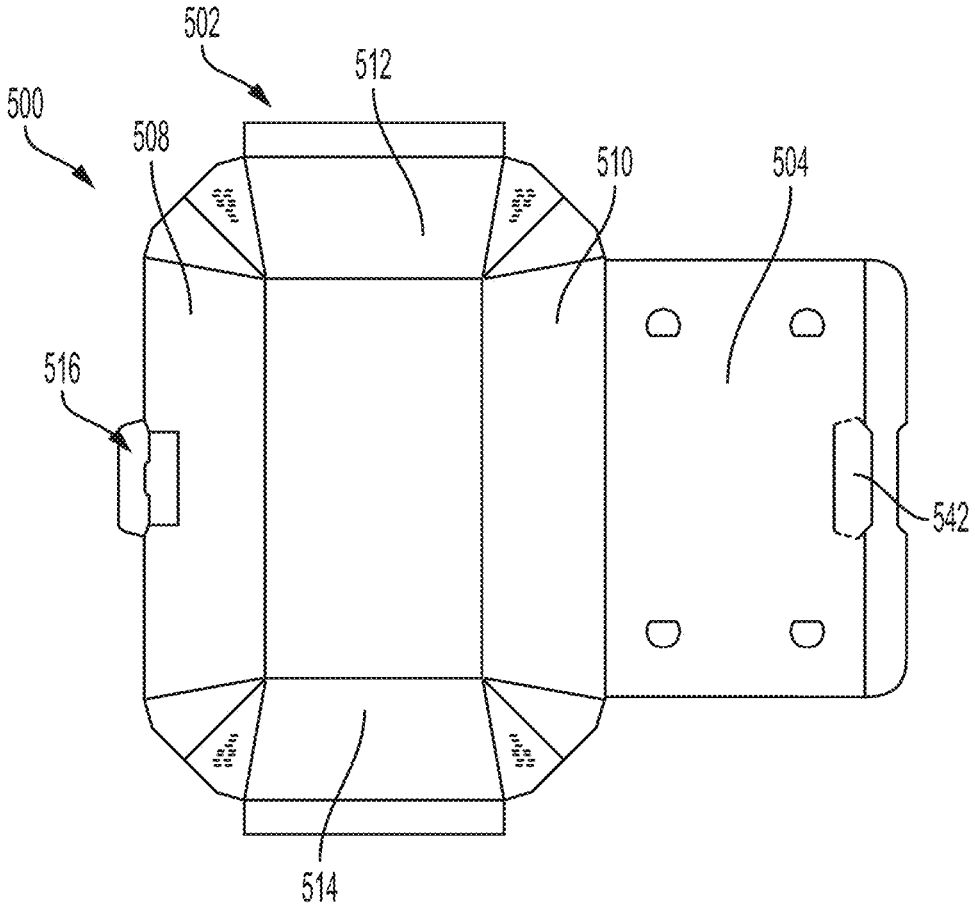
FIG. 5 is a plan view of a unitary blank for forming a food container in accordance with another aspect of the disclosed subject matter.

In accordance with another aspect of the disclosed subject matter, FIG. 5 shows a unitary blank 500 for forming a food container. Unitary blank 500, as shown in FIG. 5, can have one or more features as included in blank 100, for example, body portion 502, cover portion 504, first body wall portion 508, second body wall portion 510, third body wall portion 512, fourth body wall portion 514, body base portion 503, closure tab 516, and release flap 542. It is to be recognized that the dimensions and relative proportions of the body portion 502, cover portion 504, and body wall portions 508, 510, 512, 514, etc. of the blank 500 will vary according to the exact size and intended use of the blank 500. For purpose of illustration and not limitation, with reference to the blank 500 of FIG. 5, the unitary blank can have a width of about 17.5 to 18 inches. The body portion 502 can have a height of about 16 to 18.5 inches. The first and second body wall portions 508, 510 can have a width of about 2.5 to 3.5 inches. The first and second body wall portions 508, 510 can have a height at an inner edge of about 4.5 to 5 inches and a height at an outer edge of about 5.5 to 6 inches. The third and fourth body wall portions 512, 514 can have a height of about 2.5 to 3.5 inches. The third and fourth body wall portions 512, 514 can have a width at an inner edge of about 4.5 to 5 inches and a width at an outer edge of about 5.5 to 6 inches. The cover portion 504 can have a width of 5.5 to 6 inches. Although particular dimensions are described, any suitable dimensions can be used.

Figure 6:
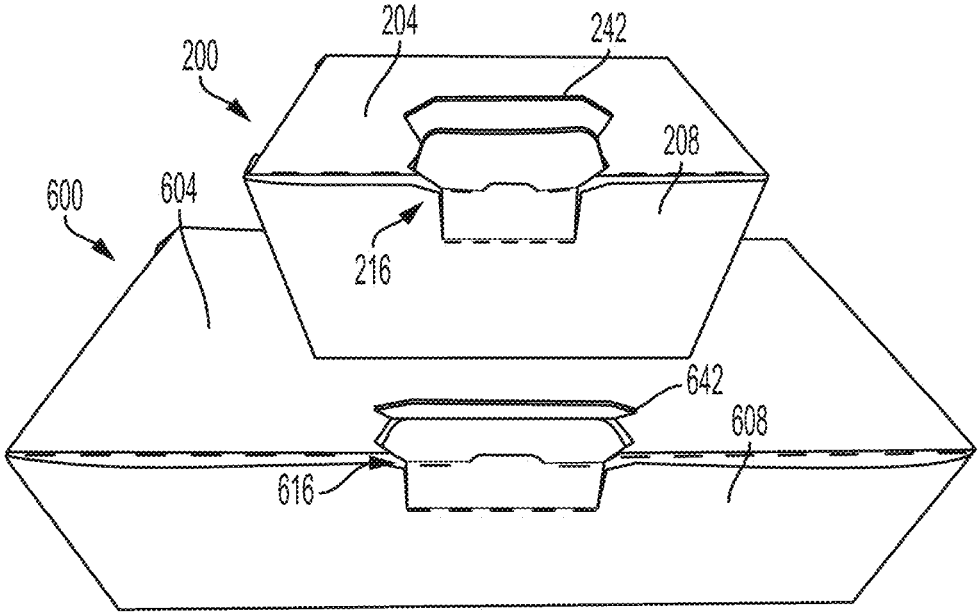
FIG. 6 is a perspective view of a stacked arrangement of multiple food container in accordance with the disclosed subject matter.

Additionally, for purpose of illustration and not limitation, FIG. 6 depicts a stacked arrangement of container 200 formed from blank 100 and container 600 formed from blank 500. For example, containers 200 and 600 can include features such as cover portion 204, 604, side wall 208, 608, closure tab 216, 616, and release flap 242, 642. Although particular features are described, container 600 can have one or more of the features as included in blank 500 and container 200.

Figure 7A:
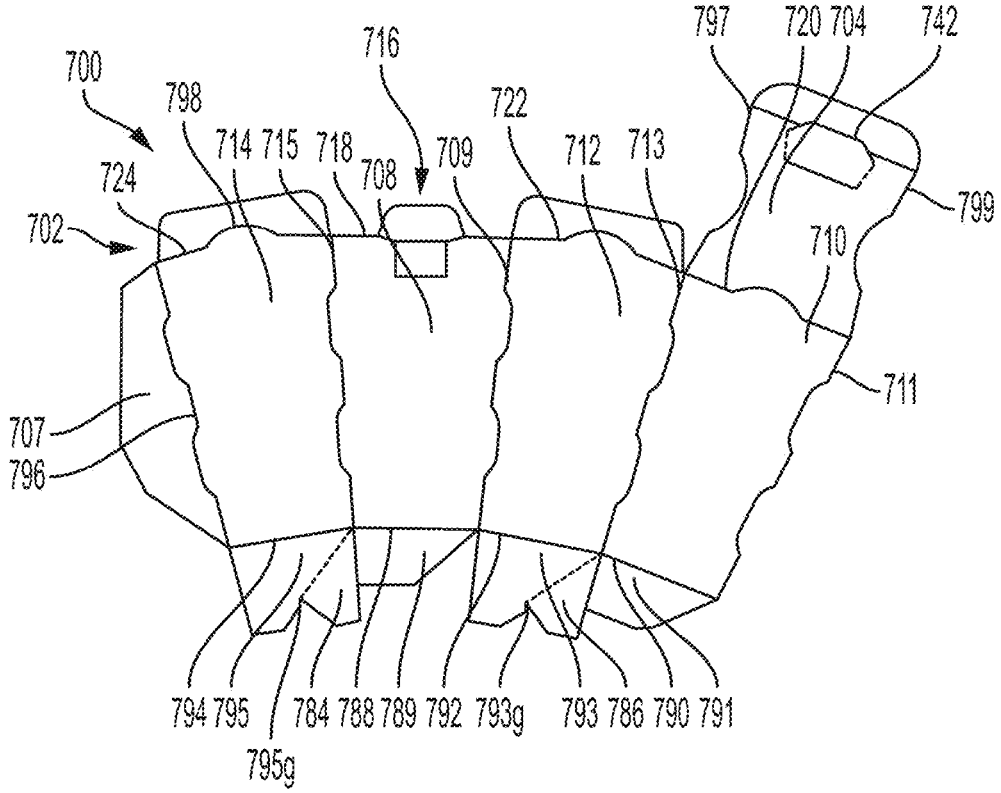
FIG. 7*a* is a plan view of a unitary blank for forming a food container in accordance with another aspect of the disclosed subject matter.

In accordance with the disclosed subject matter, FIG. 7*a* shows a unitary blank 700 for forming a food container 800, as shown in FIGS. 8*a*-9*b*. Unitary blank 700, as shown in FIG. 7*a*, can have one or more features as included in blank 100, for example, body portion 702, cover portion 704, first body wall portion 708, second body wall portion 710, third body wall portion 712, fourth body wall portion 714, closure tab 716, and release flap 742. Closure tab 716 and release flap 742 can be configured similarly and operate similarly to closure tab 216 and release flap 242 described above. Each body wall portion can have an upper edge 718, 720, 722, 724, respectively, and a lower edge 788, 790, 792, 794, respectively. Second and fourth body wall portions 710, 714 can have outer edges 711, 796, respectively. First and fourth body wall portions 708, 714 can share a first inner edge 715, first and third body wall portions 708, 712 can share a second inner edge 709, and second and third body wall portions 710, 712 can share a third inner edge 713. Unitary blank 700 can also include a first base portion 789 extending from the lower edge 788 of first body wall portion 708, a second base portion 791 extending from the lower edge 790 of second body wall portion 710, a third base portion 793 extending from the lower edge 792 of third base portion 712, and a fourth base portion 795 extending from the lower edge 794 of fourth base portion 714, and a join flap 707 extending from the outer edge 796 of fourth body wall portion 714. Base portion 795 can include groove 795*g* and flap 784, and base portion 792 can include groove 793*g* and flap 786. Unitary blank 700 can further include a plurality of vent cut-outs 798 along of the edges 709, 711, 713, 715, 718, 720, 722, 724, 796 of the body wall portions 708, 710, 712, 714 and edges 797, 799 of the cover portion 704. The vent cut-outs 798 can be of any suitable shape and dimension, including but not limited to concave shapes, convex shapes, "c"-shaped or arcuate radius corners, angled straight edges, or non-radius corner die-cuts which can pop-out when the carton is erected. Alternatively, the vent cut-outs 798 can be any suitable shape or dimension that is fully die-cut and removed during manufacture.

Figure 8A:
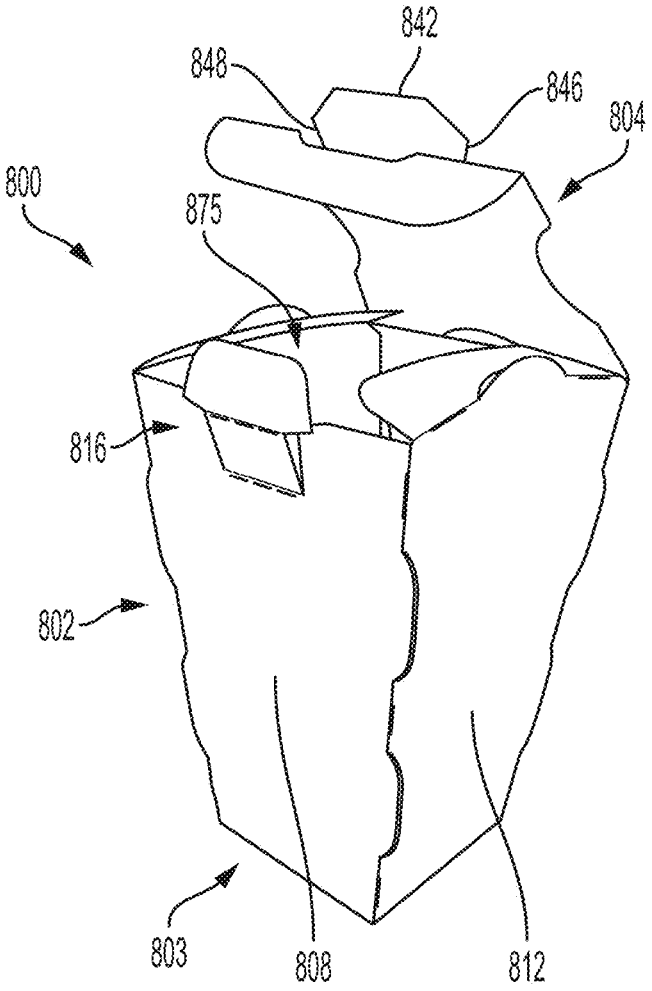
FIG. 8*a* is a perspective view of a food container in accordance with the disclosed subject matter, shown with the cover portion in an open configuration.
Figure 8B:
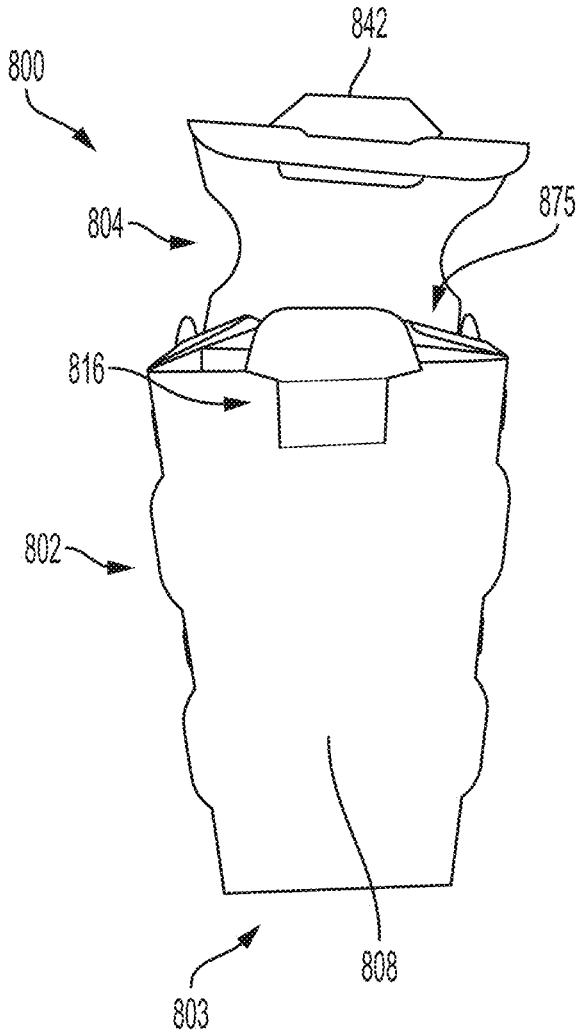
FIG. 8*b* is a front view of the container of FIG. 8*a*.
Figure 9A:
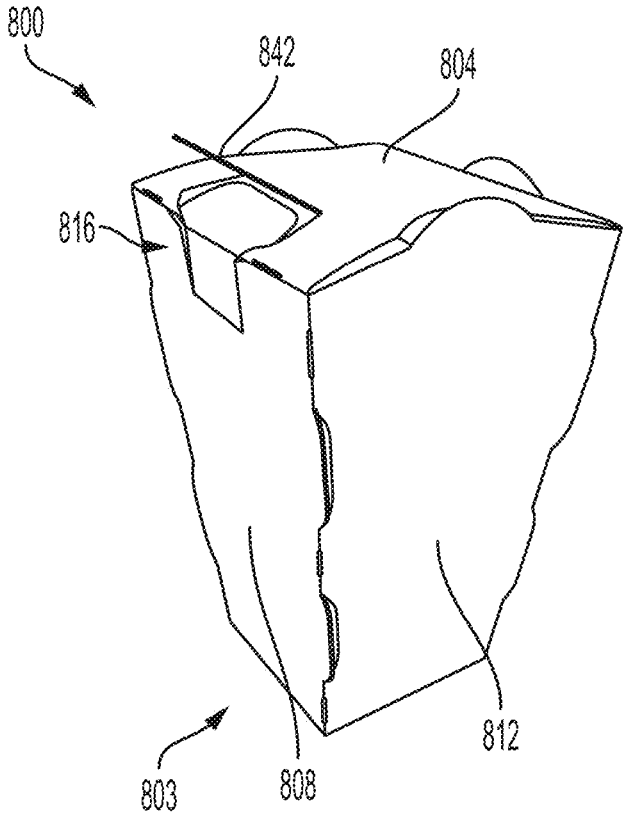
FIG. 9*a* is a perspective view of the container of FIG. 8*a*, shown with the release flap in the open configuration and the closure tab in the engaged position.
Figure 9B:
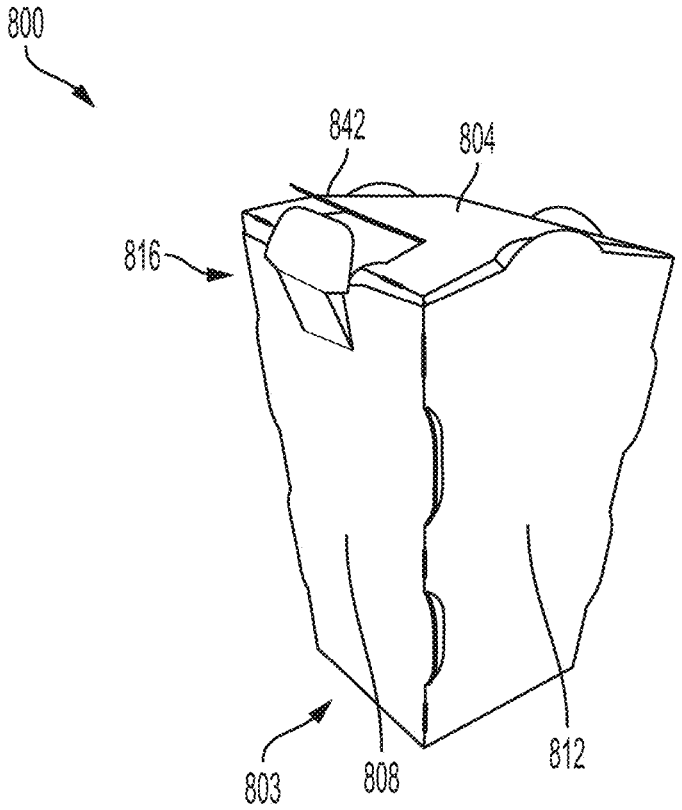
FIG. 9*b* is a perspective view of the container of FIG. 8*a*, shown with the release flap in the open configuration and the closure tab in the disengaged position.
Figure 9C:
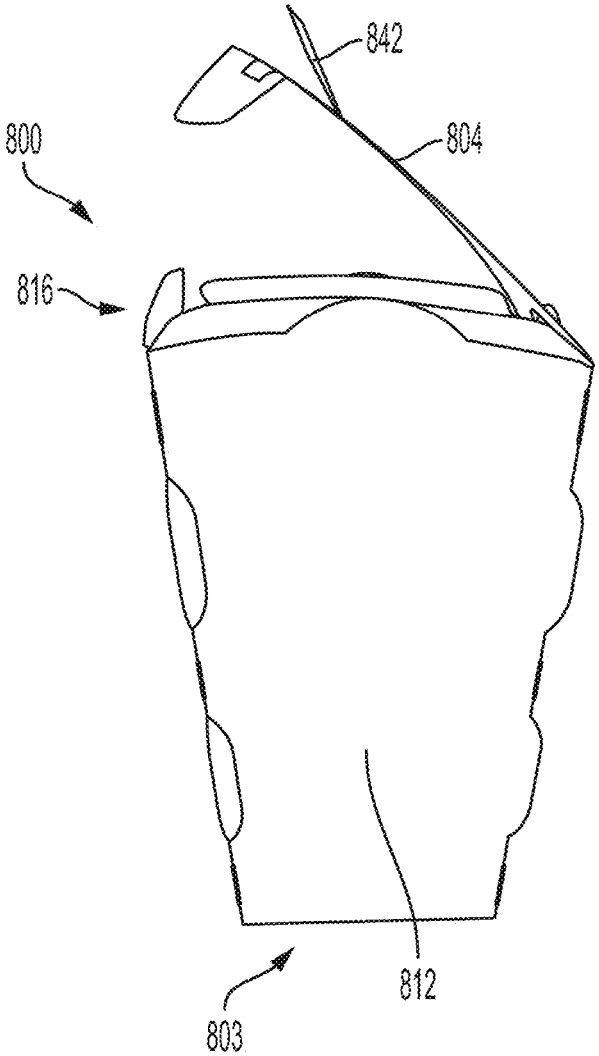
FIG. 9*c* is a side view of the container of FIG. 8*a*, shown with the cover portion in the open configuration.
Figure 10:
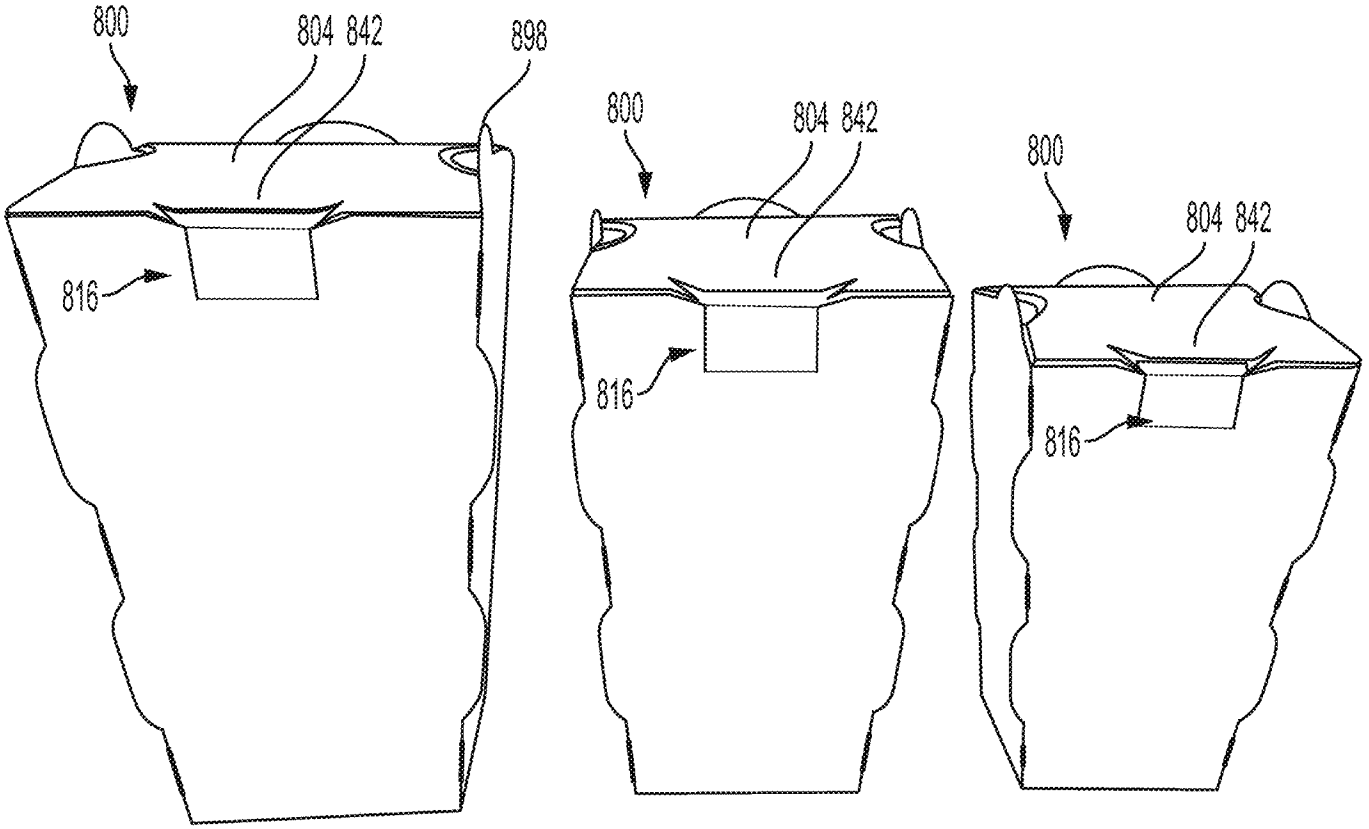
FIG. 10 is a perspective view of multiple food container in accordance with the disclosed subject matter.

To form container 800 from blank 700, join flap 707 can be folded about outer edge 796 of fourth body wall portion 714 to join with first body portion 708, using conventional techniques, such as by glue or thermal adhesive or the like, to define first, second, third, and fourth side walls 808, 810, 812, 814 of the container 800, as shown in FIGS. 8*a*-8*b* and 9*a*-9*c*. Body base 803 is an auto-bottom, which is known in the art. To form the body base 803, base portions 789 and 791 can be folded along lower edges 788, 790, respectively. Then, base portions 795 and 793 can be folded along lower edges 792, 794, respectively, such that grooves 793*g*, 795*g* on base portions 793, 795 intersect with each other and can be joined. The flaps 784, 786 can then be folded between an open position and a closed position to allow for securing of body base 803. For example, flap 784 can be folded to the open position, and folded to the closed position to join to base portion 789. Similarly, flap 786 can be folded to the open position, and folded to the closed position to join to base portions 791. Flaps 784 and 786 can be joined to base portions 789 and 791 using conventional techniques, such as by glue or thermal adhesive or the like. A body portion 802 and a cover portion 804 can be joined together to define an interior 875. Although particular features are described, the container 800 can have one or more of the features as included in blank 100, blank 700, and container 200. To cover the container 800, the cover portion 804 can be moveable between an open position (as shown in FIGS. 8*a*-8*b*, 9*c*) and a closed position (as shown in FIGS. 9*a*-9*b*). The container 800 can contain a plurality of vent cut-outs 898 (for example, see FIG. 10), which can provide venting of the food items when container 800 is closed. The interaction between the cover portion 804, a closure tab 816 and a release flap 842 can be the same as described above with respect to container 200. Particularly, after food items or other perishable and nonperishable products are placed in container 800, the container can be closed and locked with the closure tab 816 (for example, as shown in FIG. 10). To remove the food items from container 800 after it has been closed and locked, the release flap 842 can be lifted (as shown in FIGS. 9*a*-9*c*), tearing along first and second release flap score lines 846, 848 (as shown in FIG. 9*a*), allowing the extraction of the closure tab 816, and indicating that the container 800 has been opened from its closed and locked position. Additionally, for purpose of understanding, FIG. 10 depicts an arrangement of a variety of similar containers 800 of different sizes. It is to be recognized that the dimensions and relative proportions of the features of the blank 700 or container 800 can vary according to the exact size and intended use of the blank 700 or container 800.

Figure 7B:
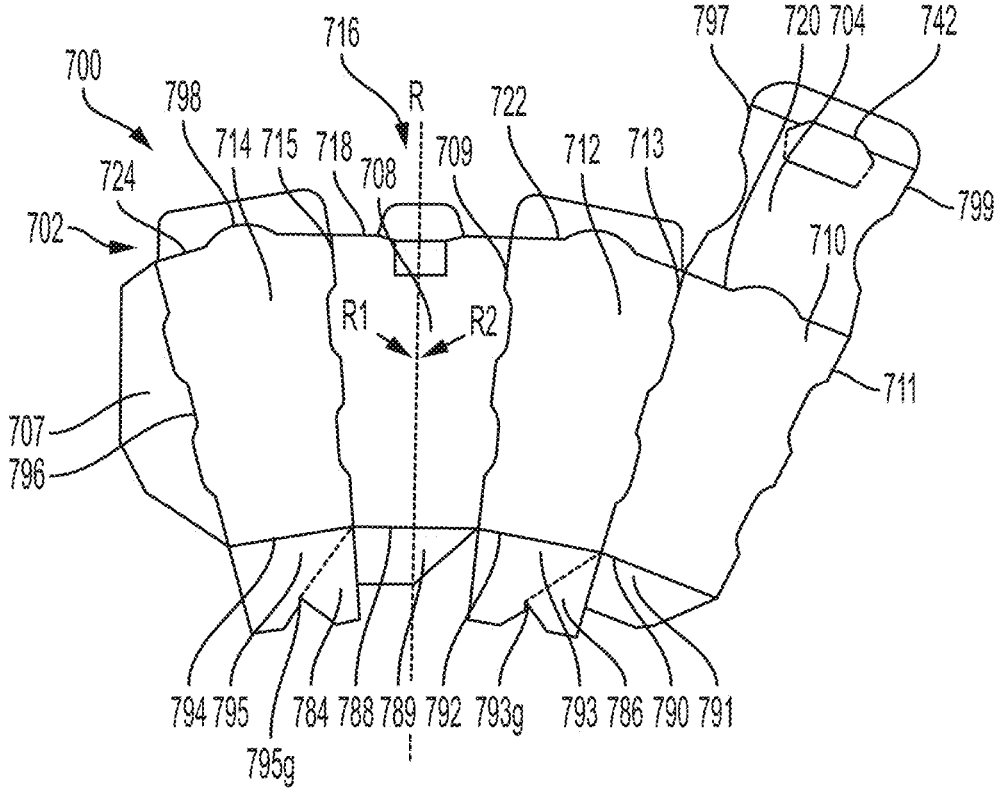
FIG. 7*b* is a plan view of a unitary blank for forming a food container in accordance with another aspect of the disclosed subject matter.

In accordance with another aspect of the disclosed subject matter, the pattern of unitary blank 700 of FIG. 7*a* can be shifted or adjusted such that the outer edges correspond with reference line R to define two outer edges R1 and R2, as shown in FIG. 7*b*. Reference line R can be located vertically through closure tab 716 and body wall portion 708. As such, edges 711 and 796 can be joined to define an inner edge. The closure tab 716 can have two closure tab portions. When the container 800 is formed from blank 700, the closure tab portions can be joined to form closure tab 816, as shown in FIG. 8*a*, using conventional techniques, such as by glue or thermal adhesive or the like.

Figure 11:
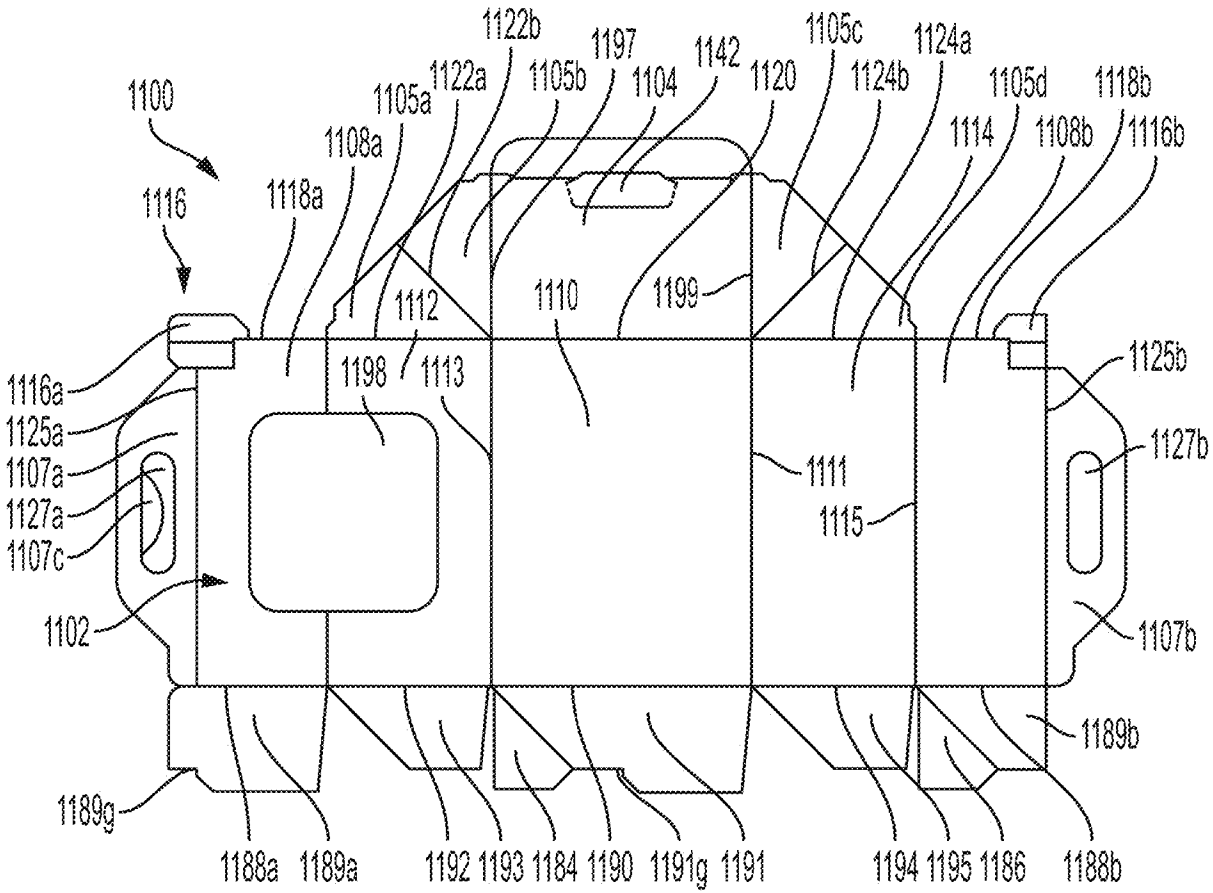
FIG. 11 is a plan view of a unitary blank for forming a food container in accordance with another aspect of the disclosed subject matter.
Figure 12:
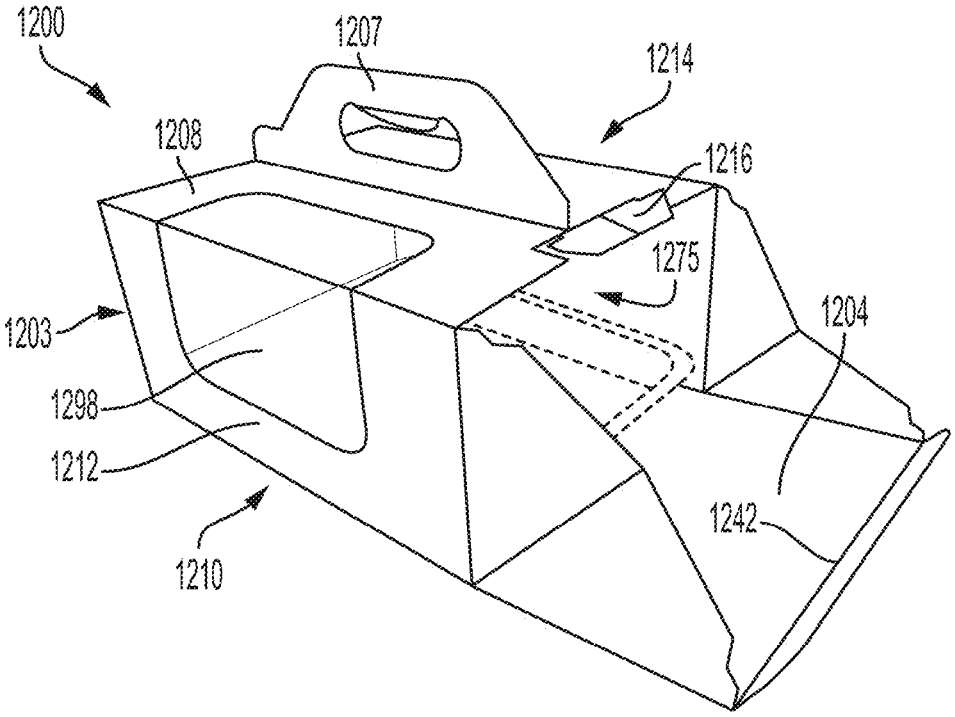
FIG. 12 is a perspective view of a food container in accordance with the disclosed subject matter, shown with the cover portion in an open configuration.

For example, in accordance with another aspect of the disclosed subject matter, FIG. 11 shows a unitary blank 1100 for forming a food container 1200, as shown in FIG. 12. The unitary blank 1100, as shown in FIG. 11, can have one or more features as included in blank 100, for example, a body portion 1102, a cover portion 1104, a closure tab 1116, and a release flap 1142. The closure tab 1116 and the release flap 1142 can be configured similarly and operate similarly to closure tab 216 and release flap 242 described above. The unitary blank 1100 can include first, second, third, fourth, and fifth body wall portions 1108*a*, 1112, 1110, 1114, 1108*b*, respectively. Each body wall portion can have an upper edge 1118*a*, 1122*a*, 1120, 1124*a*, 1118*b*, respectively, and a lower edge 1188*a*, 1192, 1190, 1194, 1188*b*, respectively. The first and fifth body wall portions 1108*a*, 1108*b* can have outer edges 1125*a*, 1125*b*, respectively. The first and second body wall portions 1108*a*, 1112 can share a first inner edge 1109. The second and third body wall portions 1112, 1110 can share a second inner edge 1113. The third and fourth body wall portions 1110, 1114 can share a third inner edge 1111. The fourth and fifth body wall portions 1114, 1108*b* can share a fourth inner edge 1115. The unitary blank 1100 can further include auto-bottom body wall portions 1189*a*, 1193, 1191, 1195, 1189*b* extending from the lower edges 1188*a*, 1192, 1190, 1194, 1188*b* of the body wall portions, 1108*a*, 1112, 1110, 1114, 1108*b*, respectively. The auto-bottom body wall portions 1191 and 1189*b* can include flaps 1184 and 1186, respectively. The unitary blank 1100 can further include cover side portions 1105*a*, 1105*b* extending between the body portion 1112 and the cover portion 1104, respectively, where the cover side portions 1105*a* and 1105*b* can share an inner edge 1122*b*. The unitary blank 1100 can further include cover side portions 1105*c*, 1105*d* extending between the cover portion 1104 and the body portion 1114, respectively, where the cover side portions 1105*c* and 1105*d* can share an inner edge 1124*b*. The unitary blank 700 can further include a window cut-out 1198 on one or more body wall portions, for example, body wall portions 1108*a*, 1112. The window cut-out 1198 can be of any suitable shape and dimension including but not limited to rectangles, ovals, and circles. Alternatively, the window cut-out 1198 can be any suitable shape or dimension that is fully die-cut and removed during manufacture. The window cut-out 1198 can be covered with any suitable material during manufacture, including polyester, PLA, and acetate films.

The unitary blank 1100 can further include handle portions 1107*a*, 1107*b* extending from the outer edges 1125*a*, 1125*b* respectively. The handle portions 1107*a*, 1107*b* can contain handle cut-outs 1127*a*, 1127*b*, respectively. The handle portion 1107*a* can further include a handle flap 1107*c* extending from the edge of the handle cut-out 1127*a*. The handle cut-outs 1127*a*, 1127*b* can be of any suitable shape and dimension including but not limited to rectangles, ovals, and circles. Alternatively, the handle cut-outs 1127*a*, 1127*b* can be any suitable shape or dimension that is fully die-cut and removed during manufacture To form the container 1200 from the blank 1100, the handle portions 1107*a*, 1107*b* of FIG. 11 can be folded about the outer edges 1125*a*, 1125*b* and joined to form a handle 1207, as shown by FIG. 12, using conventional techniques, such as by glue or thermal adhesive or the like. The handle flap 1107*c* can be folded through the handle cut-out 1127*b* to secure the handle 1207. When the handle portions 1107*a*, 1107*b* of FIG. 11 are joined, the closure tab portions 1116*a*, 1116*b* can also be joined to form the closure tab 1216, using conventional techniques, such as by glue or thermal adhesive or the like. The container 1200 can also include first, second, third, and fourth side walls 1208, 1210, 1212, 1214 of container 1200. A body portion 1202 and a cover portion

1204 can be joined together to define an interior 1275. To cover the container 1200, the cover portion 1204 can be moveable between an open position (as shown in FIG. 12) and a closed position by folding the cover side portions 1105*a* and 1105*b* of FIG. 11 along the edge 1122*b*, and folding the cover side portions 1105*c* and 1105*d* along the edge 1124*b*, such that the cover side portions 1105*a*, 1105*b*, 1105*c*, 1105*d* are inside the box when the cover portion 1204 is in the closed position. The interaction between the cover portion 1204, the closure tab 1216 and a release flap 1242 can be the same as described above with respect to container 800. Although particular features are described, the container 1200 can have one or more of the features as included in blank 100, blank 700, and containers 200, 800. It is to be recognized that the dimensions and relative proportions of the features of the blank 1100 or container 1200 can vary according to the exact size and intended use of the blank 1100 or container 1200.

To form the auto-bottom side wall 1203 of FIG. 12, the auto-bottom body wall portions 1189*a*, 1193, 1195 of FIG. 11 can be folded along the lower edges 1188*a*, 1192, 1194, respectively. Auto-bottom side wall 1203 can be a "side-oriented" auto-bottom, which is known in the art. The auto-bottom body wall portions 1191, 1189*b* can then be folded along the lower edges 1190, 1188*b* respectively, such that grooves 1189*g*, 1191*g* intersect with each other and can be joined. The flaps 1184, 1186 can then be folded between an open position and a closed position to allow for securing of the auto-bottom side wall 1203 of FIG. 12. For example, the flap 1184 can be folded to the open position, covered with glue or thermal adhesive or the like on an inner side, and folded to the closed position to join to the auto-bottom body wall portions 1189*a*, 1193. Similarly, the flap 1186 can be folded to the open position, covered with glue or thermal adhesive or the like on an inner side, and folded to the closed position to join to the auto-bottom body wall portions 1194, 1189*b*. The container 1200 can contain a window 1298, which can provide a view of food items when container 1200 is closed. Although certain features of container 1200 are referred to as "cover," "bottom," "base," "side," or "wall," the terms are not intended to be limiting, and container 1200 can be placed on any of its cover, bottom, base, or side, with any of the cover, bottom, base, or side portions extending upwardly and any of the cover, base, or side portions resting along a "top."

The containers disclosed herein are preferably disposable, but it is contemplated that they can be reused at a future time. Also, the containers can be constructed from materials suitable to be placed in a heating apparatus, such as a microwave, to heat the food and/or used for storage in the refrigerator or freezer. Additionally, the materials from which the food container 200 is made need not be the same throughout. The containers and blanks described herein can be manufactured from any suitable material, including but not limited to paperboard, paper, paper laminated on at least one side, multiple-walled paper, resin, plastic and other polymers, suitable composite materials, and/or suitable foams.

In addition to the disclosed subject matter claimed below, the disclosed subject matter is also directed to other aspects of the disclosed subject matter having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other aspects of the disclosed subject matter having any other possible combinations. Thus, the foregoing description of the disclosed subject matter has been presented for purposes of illustration and description. It is not intended to be exhaustive or to limit the disclosed subject matter to the aspects of the disclosed subject matter disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A unitary blank for forming a container comprising:

a body portion having an upper edge, a lower edge, a first outer edge and a second outer edge opposite the first outer edge, the body portion further having a plurality of fold lines extending between the upper edge and the lower edge to define a plurality of body wall portions;

at least one join flap extending from at least one of the first outer edge and second outer edge;

a first body wall portion of the plurality of body wall portions including a closure tab extending from the first body wall portion, the closure tab including a closure tab flap portion and a closure tab base portion;

a cover portion extending from the upper edge of a second body wall portion of the plurality of body wall portions, the cover portion including a release flap and configured to receive the closure tab flap portion of the first body wall portion;

a first side flap extending from the upper edge of a third body wall portion of the plurality of body wall portions; and a second side flap extending from the upper edge of a fourth body wall portion of the plurality of body wall portions, wherein a plurality of vent cut-outs are formed along the plurality of fold lines, each vent cut-out defining a convex pop out tab and a concave recess when folded along a respective fold line, wherein at least one vent cut-out is formed along the upper edge of the second body wall portion, the at least one vent cut-out along the upper edge of the second body wall portion defining a convex pop out tab and a concave recess when the cover portion is folded along the upper edge of the second body wall portion, wherein at least one vent cut-out is formed along the upper edge of the third body wall portion and at least one vent cut-out is formed along the upper edge of the fourth body wall portion, each at least one vent cut-out along the upper edge of the third body wall portion defining a convex pop out tab and a concave recess when the first side flap is folded along the upper edge of the third body wall portion and each at least one vent cut-out along the fourth body wall portion defining a convex pop out tab and a concave recess when the second side flap is folded along the upper edge of the fourth body wall portion, wherein the cover portion includes a first side edge and a second side edge, and further wherein at least one concave recess is formed along the first side edge of the cover portion and at least one concave recess is formed along the second side edge of the cover portion.

2. The blank of claim 1, wherein the plurality of vent cut-outs are die-cuts.

3. The blank of claim 1, wherein the plurality of vent cut-outs along the plurality of fold lines and the at least one vent cut-out along the upper edge of the second body wall portion are configured to provide venting when the blank is formed into a container.

4. The blank of claim 1, wherein the first body wall portion has a first inner edge and a second inner edge, the second body wall portion has an inner edge and an outer edge defined by one of the first outer edge and second outer edge of the body portion, the third body wall portion has a first inner edge and a second inner edge, and the fourth body wall portion has an inner edge and an outer edge defined by the other of the first outer edge and second outer edge of the body portion, wherein the fourth body wall portion extends from the first inner edge of the first body wall portion, the third body wall portion extends from second inner edge of the first body wall portion, and the second body wall portion extends from the second inner edge of the third body wall portion.

5. The blank of claim 4, wherein the plurality of fold lines with the vent cut-outs formed there along are located at the first and second inner edges of the first body wall portion, the inner edge of the second body wall portion, the first and second inner edges of the third body wall portion, and the inner edge of the fourth body wall portion.

6. The blank of claim 1, wherein the plurality of vent cut-outs includes vent cut-outs formed along the first outer edge and second outer edge.

7. The blank of claim 1, further including auto-bottom body wall portions extending from the lower edge of the body portion and configured to form a bottom portion when the blank is formed into a container.

8. The blank of claim 1, wherein the closure tab flap portion is defined by a closure tab flap upper edge, a closure tab flap score line, a first closure tab flap extension line, and a second closure tab flap extension line.

9. The blank of claim 1, wherein the release flap is defined by a release flap fold line, a first release flap score line, a second release flap score line, a first release flap extension line, a second release flap extension line, and a release flap edge.

10. The blank of claim 1, further wherein the convex pop out tab of the at least one vent cut-out formed along the upper edge of the third body wall portion is configured to overlap with the at least one concave recess formed along the first side edge of the cover portion when the cover is folded along the upper edge of the second body wall portion, and further wherein the convex pop out tab of the at least one vent cut-out formed along the upper edge of the fourth body wall portion is configured to overlap with the at least one concave recess formed along the second side edge of the cover portion when the cover is folded along the upper edge of the second body wall portion.

11. The blank of claim 1, wherein the first outer edge and the second outer edge are angled relative to each other.

12. The blank of claim 1, wherein at least one of the plurality of body wall portions tapers in width between the upper edge and the lower edge.

13. The blank of claim 12, wherein the at least one of the plurality of body wall portions has a trapezoidal shape.

14. The blank of claim 13, wherein each of the plurality of body wall portions has a trapezoidal shape.

* * * * *